US005298177A

United States Patent [19]

Stoffa

[11] Patent Number: 5,298,177

[45] Date of Patent: Mar. 29, 1994

[54] FUNCTIONAL FLUID WITH TRIGLYCERIDES, DETERGENT-INHIBITOR ADDITIVES AND VISCOSITY MODIFYING ADDITIVES

[75] Inventor: John V. Stoffa, North Olmstead, Ohio

[73] Assignee: The Lubrizol Corporation, Wickliffe, Ohio

[21] Appl. No.: 58,614

[22] Filed: May 5, 1993

Related U.S. Application Data

[63] Continuation-in-part of Ser. No. 743,536, Aug. 9, 1991.

[51] Int. Cl.[5] ..... C10M 141/00

[52] U.S. Cl. ..... 252/18; 252/51.005 R; 252/51.005 A; 252/56 R; 252/56 S; 252/49.006; 252/33.004; 252/25

[58] Field of Search ..... 252/56 S, 56 R, 51.5 R, 252/18, 49.6, 25, 33.4

[56] References Cited

U.S. PATENT DOCUMENTS

| | | | |
|---|---|---|---|
| 1,789,927 | 1/1931 | Murrill et al. | 252/50 |
| 2,330,773 | 9/1943 | Zimmer et al. | 252/56 |
| 2,366,517 | 1/1945 | Gleason | 252/56 |
| 2,389,227 | 11/1945 | Wright | 252/56 |
| 2,413,353 | 12/1946 | Hunter et al. | 252/56 |
| 3,130,159 | 4/1964 | Stedt | 252/31 |
| 3,640,860 | 2/1972 | Miller | 252/56 |
| 3,702,300 | 11/1972 | Coleman | 252/51.5 |
| 3,776,847 | 12/1973 | Pearson et al. | 252/33 |
| 3,953,347 | 4/1976 | Habiby | 252/48.6 |
| 4,108,785 | 8/1978 | Sturwold | 252/56 |
| 4,222,884 | 9/1980 | Malec | 252/52 |
| 4,278,554 | 7/1981 | Malec | 252/52 |
| 4,321,153 | 3/1982 | Recchuite | 252/48.6 |
| 4,532,059 | 7/1985 | Rosenberger | 252/52 |
| 4,604,221 | 8/1986 | Bryant et al. | 252/51.5 |
| 4,637,885 | 1/1987 | Fukuyama et al. | 252/32.5 |
| 4,637,887 | 1/1987 | Worschech et al. | 252/56 |
| 4,652,385 | 3/1987 | Cohen | 252/48.6 |
| 4,783,274 | 11/1988 | Jokinen et al. | 252/32.7 |
| 4,826,615 | 5/1989 | Rossi et al. | 252/56 |
| 4,925,581 | 5/1990 | Erickson et al. | 252/48.2 |
| 5,157,088 | 10/1992 | Dishong et al. | 252/51.5 A |
| 5,209,860 | 5/1993 | Trivett | 252/56 R |

*Primary Examiner*—Jacqueline V. Howard

*Attorney, Agent, or Firm*—James L. Cordek; Frederick D. Hunter, Sr.; Joseph P. Fischer

[57] ABSTRACT

A functional fluid is disclosed which comprises (A) at least one triglyceride;

(B) at least one detergent-inhibitor additive; and (C) at least one viscosity modifying additive and further comprising (D) at least one synthetic oil.

61 Claims, No Drawings

FUNCTIONAL FLUID WITH TRIGLYCERIDES, DETERGENT-INHIBITOR ADDITIVES AND VISCOSITY MODIFYING ADDITIVES

This is a continuation-in-part of application Ser. No. 07/743,536 filed Aug. 9, 1991.

BACKGROUND OF THE INVENTION

A functional fluid is a term which encompasses a variety of fluids including, but not limited to, tractor fluids, automatic transmission fluids, manual transmission fluids, hydraulic fluids, power steering fluids, fluids related to power train components and fluids which have the ability to act in various different capacities. It should be noted that within each of these fluids such as, for example, automatic transmission fluids, there are a variety of different types of fluids due to the various transmissions having different designs which have led to the need for fluids of markedly different functional characteristics. One type of functional fluid is generally known as a tractor fluid which can be used in connection with various types of tractor equipment in order to provide for the operation of the transmission, gears, bearings, hydraulics, power steering, mechanical power take off and oil immersed brakes of the tractor.

The components included within a functional fluid such as a tractor fluid must be carefully chosen so that the final resulting fluid composition will provide all the necessary characteristics required and pass a variety of different types of tests. In general, a tractor fluid must act as a lubricant, a power transfer means and a heat transfer means.

Tractor fluids have a number of important specific characteristics which provide for their ability to operate within tractor equipment. Such characteristics include the ability to provide proper frictional properties for preventing wet brake chatter of oil immersed brakes while simultaneously providing the ability to actuate wet brakes and provide power take-off (PTO) clutch performance. A tractor fluid must provide sufficient antiwear and extreme pressure properties as well as water tolerance/filterability capabilities.

The extreme pressure (EP) properties of tractor fluids are demonstrated by the ability of the fluid to pass a spiral bevel test as well as a straight spur gear test. The tractor fluid must pass wet brake chatter tests as well as provide adequate wet brake capacity when used in oil immersed disk brakes which are comprised of a bronze, graphitic composition, asbestos and paper. The tractor fluid must demonstrate its ability to provide friction retention for power shift transmission clutches such as those clutches which include graphitic and bronze clutches.

U.S. Pat. No. 4,783,274 (Jokinen et al, Nov. 8, 1988) is concerned with hydraulic fluids based on oily triglycerides of fatty acids. This reference relates to the need for fluids for hydraulic purposes which are based on renewable natural resources, and which are, at the same time, environmentally acceptable. One such a natural base component for hydraulic fluids would be the oily triglycerides, which are esters of natural fatty acids with straight-chained alkyl, alkenyl, alkylamines and alkatrienyl chains having a length of commonly $C_9$–$C_{22}$, and of glycerol, which triglycerides have an iodine number illustrating their degree of unsaturation, of at least 50 and not more than 128. The possibilities to make hydraulic fluids by using the said triglycerides as the base component were investigated.

U.S. Pat. No. 3,776,847 (Pearson et al, Dec. 4, 1973) relates to a lubricating oil composition for the hot rolling of metals comprising (a) from about 50 to about 85% by weight of a natural fatty oil, (b) from about 0.1 to about 10% by weight of an alkaline earth metal salt of an oil-soluble sulfonic acid and (c) from about 5 to about 49.9% by weight of a mineral lubricating oil having a viscosity index of at least 50.

U.S. Pat. No. 2,330,773 (Zimmer et al, Sep. 28, 1943) relates to adding to a suitable mineral oil base stock a small amount of a high molecular weight, oxygen-containing polymer which is depolymerizable at high temperature without charring. Small amount of fatty materials may be, and preferably are, also present.

The oxygen-containing polymer should be of a high molecular weight, e.g., at least 1000 and may be 50,000, 100,000, or even considerably higher, although it must not be so high in molecular weight as to be insoluble in the mineral oil base stocks referred to. In general, these polymers are obtained by polymerizing unsaturated monomeric chemical compounds, such as, esters, ethers, acids, etc. A particularly preferred class of polymers are those produced from esters of acrylic acid and alkyl derivatives thereof, such as methacrylic acid containing a methyl substituent in the alpha position, or other higher alkyl groups, such as, ethyl, propyl, etc., in a similar position; these esters should be derived from monohydric alcohols preferably containing more than 4 carbon atoms, such as amyl, hexyl, heptyl, octyl, lauryl, cetyl, octadecyl, etc. Such acrylic compounds contain the group $CH_2$—C, and have attached to this latter carbon atom a carboxylic ester group and either a hydrogen or a hydrocarbon group, such as, an alkyl or aryl group.

U.S. Pat. No. 2,389,227 (Wright, Nov. 20, 1945) involves the blending of a viscose hydrocarbon oil, such as a petroleum lubricating oil fraction, with a non-drying viscous oxidized or thickened fatty oil and with a small amount of an oxygen-containing high molecular weight polymer which normally is substantially solid. By a proper selection and proportioning of these ingredients, a blend can be obtained having suitable viscosity and pour point characteristics to assure proper flowing and penetration and which protectively stays on rubbing surfaces under severe operating conditions.

U.S. Pat. No. 2,413,353 (Hunter et al, Dec. 31, 1946) relates to improved cutting oil compositions.

Various types of fixed fatty oils may be used in the cutting oil compositions of this reference. These oils are intended primarily to increase the oiliness or lubricity of the resultant composition and are customarily used in amounts corresponding to 0.5 to 15.0 per cent by weight. Lard oil is particularly satisfactory for this purpose. However, other animal oils such as tallow oil, neat's-foot oil, sperm oil, wool oil, whale oil and the like may be used. Also certain fish and vegetable oils may be used. The fish oils are generally less advantageous due to their offensive odor and the vegetable oils are likewise less advantageous because of their tendency to oxidize and form gum at the temperatures encountered in cutting operations. However, by the use of a sufficient amount of oxidation inhibitor this defect may be minimized, and vegetable oils such as olive oil, rapeseed oil, corn oil and castor oil may be used.

U.S. Pat. No. 3,640,860 (Miller, Feb. 8, 1972) is concerned with a lubricating composition suitable for use in the continuous casting of metals. More specifically, this reference is concerned with a composition useful for lubricating the metal-mold interface during the continuous casting of metals, which composition contains both dimer and trimer of an unsaturated fatty acid, a glyceride oil, especially a triglyceride, as a solubilizing agent, and a mineral lubricating oil component low in carbon residue and aromatic carbon content. The mineral lubricating oil can be made by a two-state catalytic hydrogenation process.

SUMMARY OF THE INVENTION

A functional fluid, especially in the form of a tractor fluid, is disclosed which is comprised of (A) at least one triglyceride;

(B) at least one detergent-inhibitor additive; and (C) at least one viscosity modifying additive.

The functional fluid may also include (D) at least one synthetic ester base oil. Specific amounts and ranges of the above components are described below.

A primary object of this invention is to provide a functional fluid possessing a wide variety of different functional characteristics especially when used as a tractor fluid.

Another object of this invention is to provide a functional fluid capable of passing a wide variety of different tests with respect to characteristics such as EP/antiwear characteristics, water tolerance, brake capacity and chatter and filterability.

Still another object of the invention is to simultaneously provide improved performance in the areas of improved low temperature fluidity/filterability, EP/antiwear performance, friction improving properties, wet brake chatter suppression, and capacity with respect to actuating hydraulics, transmissions, power steering and braking without harming performance in other areas.

Yet another object is to increase performance with respect to EP/antiwear performance without having an undesirable effect on corrosion testing and transmission performance.

Still another object is to provide improved water tolerance by including surfactants while not limiting EP performance.

Other objects of this invention include providing a functional fluid capable of passing a wide variety of different tests with respect to characteristics such as frictional characteristics, low temperature fluidity, seal swell characteristics, antifoaming characteristics, antioxidation characteristics and EP protection as demonstrated by spiral bevel and straight spur gear testing.

Another object is to provide sufficient power steering performance while simultaneously providing sufficient transmission performance as demonstrated in Turbo Hydramatic oxidation testing (a General Motors Corp. test).

Another object is to provide a fluid which provides sufficient friction retention for power shift transmission clutches and provides corrosion inhibition particularly with respect to yellow metal (i.e., copper, brass, bronze) corrosion while simultaneously providing improved EP performance, proper frictional properties for wet brake chatter suppression and simultaneously providing wet brake capacity and power takeoff clutch performance.

A further object of this invention is to provide improved biodegradability by utilizing a triglyceride rather than a mineral oil to pass such industry wide tests as the CEC L33-T82.

A primary object of this invention is to provide a functional fluid which includes its essential components such that the fluid simultaneously provides a variety of desirable characteristics.

These and other objects of the invention will become apparent to those skilled in the art upon reading this disclosure.

DETAILED DESCRIPTION OF THE INVENTION

The present invention is produced and sold in the form of the functional fluid final product which can be included in various mechanical devices such as tractors. The essential components of the present functional fluid are: (A) at least one triglyceride; (B) at least one detergent-inhibitor additive; and (C) at least one viscosity modifying additive. An additional component (D) at least one synthetic ester base oil may also be included.

(A) The Triolyceride

The triglycerides of this invention are either a synthetic or naturally occurring triglyceride. Preferred is the naturally occurring triglyceride. The triglycerides are of the general formula

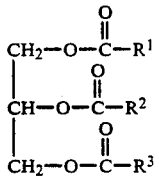

are esters having a straight chain fatty acid moiety and a glycerol moiety wherein the fatty acid moiety contains $R^1$, $R^2$ and $R^3$ which are saturated or unsaturated aliphatic hydrocarbon groups containing from about 8 to about 22 carbon atoms, preferably from about 12 to 22 carbon atoms.

Naturally occurring triglycerides having utility in this invention are exemplified by corn oil, cottonseed oil, peanut oil, olive oil, palm oil, palm kernel oil, sunflower oil, high oleic sunflower oil, coconut oil, safflower oil, rapeseed oil, low erucic rapeseed oil, canola oil, soybean oil, lard oil, beef tallow oil, and menhaden oil. Preferred is rapeseed oil, especially low erucic rapeseed oil.

(B) The Detergent-Inhibitor Additive

This invention contemplates utilizing a detergent-inhibitor additive that preferably is free from phosphorus and zinc and comprises at least one metal overbased composition B-1 and/or at least one carboxylic dispersant composition B-2, diaryl amine B-3, sulfurized composition B-4 and metal passivator B-5. The purpose of the detergent-inhibitor additive is to provide a multipurpose power transmission fluid capable of maintaining cleanliness of mechanical parts, providing anti-wear and extreme pressure gear protection, anti-oxidation performance and corrosion while also effecting proper frictional properties on all clutches and wet brakes.

(B-1) The Metal Overbased Composition

These overbased salts of organic acids are widely known to those of skill in the art and generally include metal salts wherein the amount of metal present in them exceeds the stoichiometric amount. Such salts are said to have conversion levels in excess of 100% (i.e., they comprise more than 100% of the theoretical amount of metal needed to convert the acid to its "normal" "neutral" salt). Such salts are often said to have metal ratios in excess of one (i.e., the ratio of equivalents of metal to equivalents of organic acid present in the salt is greater than that required to provide the normal or neutral salt which required only a stoichiometric ratio of 1:1). They are commonly referred to as overbased, hyperbased or superbased salts and are usually salts of organic sulfur acids, organic phosphorus acids, carboxylic acids, phenols or mixtures of two or more of any of these. As a skilled worker would realize, mixtures of such overbased salts can also be used.

The terminology "metal ratio" is used in the prior art and herein to designate the ratio of the total chemical equivalents of the metal in the overbased salt to the chemical equivalents of the metal in the salt which would be expected to result in the reaction between the organic acid to be overbased and the basically reacting metal compound according to the known chemical reactivity and stoichiometry of the two reactants. Thus, in a normal or neutral salt the metal ratio is one and in an overbased salt the metal ratio is greater than one.

The overbased salts used as (B-1) in this invention usually have metal ratios of at least about 3:1. Typically, they have ratios of at least about 12:1. Usually they have metal ratios not exceeding about 40:1. Typically salts having ratios of about 12:1 to about 20:1 are used.

The basically reacting metal compounds used to make these overbased salts are usually an alkali or alkaline earth metal compound (i.e., the Group IA, IIA, and IIB metals excluding francium and radium and typically excluding rubidium, cesium and beryllium) although other basically reacting metal compounds can be used. Compounds of Ca, Ba, Mg, Na and Li, such as their hydroxides and alkoxides of lower alkanols are usually used as basic metal compounds in preparing these overbased salts but others can be used as shown by the prior art incorporated by reference herein. Overbased salts containing a mixture of ions of two or more of these metals can be used in the present invention.

These overbased salts can be of oil-soluble organic sulfur acids such as sulfonic, sulfamic, thiosulfonic, sulfinic, sulfonic, partial ester sulfuric, sulfurous and thiosulfuric acid. Generally they are salts of carbocylic or aliphatic sulfonic acids.

The carbocylic sulfonic acids include the mono- or poly-nuclear aromatic or cycloaliphatic compounds. The oil-soluble sulfonates can be represented for the most part by the following formulae:

$$[R_x—T—(SO_3)_y]_zM_b \quad \text{(II)}$$

$$[R^4—(SO_3)_z]_dM_b \quad \text{(III)}$$

In the above formulae, M is either a metal cation as described hereinabove or hydrogen; T is a cyclic nucleus such as, for example, benzene, naphthalene, anthracene, phenanthrene, diphenylene oxide, thianthrene, phenothioxine, diphenylene sulfide, phenothiazine, diphenyl oxide, diphenyl sulfide, diphenylamine, cyclohexane, petroleum naphthenes, decahydro-naphthalene, cyclopentane, etc.: R in Formula II is an aliphatic group such as alkyl, alkenyl, alkoxy, alkoxyalkyl, carboalkoxyalkyl, etc; x is at least 1, and $R_x+T$ contains a total of at least about 15 carbon atoms, $R^3$ in Formula III is an aliphatic radical containing at least about 15 carbon atoms and M is either a metal cation or hydrogen. Examples of type of the $R^4$ radical are alkyl, alkenyl, alkoxyalkyl, carboalkoxyalkyl, etc. Specific examples of $R^4$ are groups derived from petrolatum, saturated and unsaturated paraffin wax, and polyolefins, including polymerized $C_2$, $C_3$, $C_4$, $C_5$, $C_6$, etc., olefins containing from about 15 to 7000 or more carbon atoms. The groups T, R, and $R^4$ in the above formulae can also contain other inorganic or organic substituents in addition to those enumerated above such as, for example, hydroxy, mercapto, halogen, nitro, amino, nitroso, sulfide, disulfide, etc. In Formula II, x, y, z and b are at least 1, and likewise in Formula III, a, b and d are at least 1.

Specific examples of sulfonic acids useful in this invention are mahogany sulfonic acids; bright stock sulfonic acids; sulfonic acids derived from lubricating oil fractions having a Saybolt viscosity from about 100 seconds at 100° F. to about 200 seconds are 210° F.; petrolatum sulfonic acids; mono- and poly-wax substituted sulfonic and polysulfonic acids of, e.g., benzene, naphthalene, phenol, diphenyl ether, napthalene disulfide, diphenylamine, thiophene, alpha-chloronaphthalene, etc.; other substituted sulfonic acids such as alkyl benzene sulfonic acids (where the alkyl group has at least 8 carbons), cetylphenol mono-sulfide sulfonic acids, dicetyl thianthrene disulfonic acids, dilauryl beta naphthyl sulfonic acid, dicapryl nitronaphthalene sulfonic acids, and alkaryl sulfonic acids such as dodecyl benzene "bottoms" sulfonic acids.

The latter acids derived from benzene which has been alkylated with propylene tetramers or isobutene trimers to introduce 1,2,3, or more branched-chain $C_{12}$ substituents on the benzene ring. Dodecyl benzene bottoms, principally mixtures of mono-and di-dodecyl benzenes, are available as by-products from the manufacture of household detergents. Similar products obtained from alkylation bottoms formed during manufacture of linear alkyl sulfonates (LAS) are also useful in making the sulfonates used in this invention.

The production of sulfonates from detergent manufacture-by-products by reaction with, e.g., $SO_3$, is well known to those skilled in the art. See, for example, the article "Sulfonates" in Kirk-Othmer "Encyclopedia of Chemical Technology", Second Edition, Vol. 19, pp. 291 at seq. published by John Wiley & Sons, N.Y. (1969).

Other descriptions of overbased sulfonate salts and techniques for making them can be found in the following U.S. Pat. Nos. 2,174,110; 2,174,506; 2,174,508; 2,193,824; 2,197,800; 2,202,781; 2,212,786; 2,213,360; 2,228,598; 2,223,676; 2,239,974; 2,263,312; 2,276,090; 2,276,297; 2,315,514; 2,319,121; 2,321,022; 2,333,568; 2,333,788; 2,335,259; 2,337,552; 2,346,568; 2,366,027; 2,374,193; 2,383,319; 3,312,618; 3,471,403; 3,488,284; 3,595,790; and 3,798,012. These are hereby incorporated by reference for their disclosures in this regard.

Also included are aliphatic sulfonic acids such as paraffin wax sulfonic acids, unsaturated paraffin wax sulfonic acids, hydroxy-substituted paraffin wax sulfonic acids, hexapropylene sulfonic acids, tetra-amylene sulfonic acids, polyisobutene sulfonic acids wherein the polyisobutene contains from 20 to 7000 or more carbon atoms, chloro-substituted paraffin wax sulfonic acids, nitroparaffin wax sulfonic acids, etc.; cycloaliphatic sulfonic acids such as petroleum naphthene sulfonic acids, cetyl cyclopentyl sulfonic acids, lauryl cyclohexyl sulfonic acids, bis-(di-isobutyl) cyclohexyl sulfonic acids, etc.

With respect to the sulfonic acids or salts thereof described herein and in the appended claims, it is intended that the term "petroleum sulfonic acids" or "petroleum sulfonates" includes all sulfonic acids or the salts thereof derived from petroleum products. A particularly valuable group of petroleum sulfonic acids are the mahogany sulfonic acids (so called because of their reddish-brown color) obtained as a by-product from the manufacture of petroleum white oils by a sulfuric acid process.

Generally Group IA, IIA and IIB overbased salts of the above-described synthetic and petroleum sulfonic acids are typically useful in making (B-1) of this invention.

The carboxylic acids from which suitable overbased salts for use in this invention can be made include aliphatic, cycloaliphatic, and aromatic mono- and polybasic carboxylic acids such as the napthenic acids, alkyl- or alkenyl-substituted cyclopentanoic acids, alkylor alkenyl-substituted cyclohexanoic acids, alkyl- or alkenyl-substituted aromatic carboxylic acids. The aliphatic acids generally contain at least 8 carbon atoms and preferably at least 12 carbon atoms. Usually they have no more than about 400 carbon atoms. Generally, if the aliphatic carbon chain is branched, the acids are more oil-soluble for any given carbon atoms content. The cycloaliphatic and aliphatic carboxylic acids can be saturated or unsaturated. Specific examples include 2-ethylhexanoic acid, a-linolenic acid, propylene-tetramer-substituted maleic acid, behenic acid, isostearic acid, pelargonic acid, capric acid, palmitoleic acid, linoleic acid, lauric acid, oleic acid, ricinoleic acid, undecylic acid, dioctylcyclopentane carboxylic acid, myristic acid, dilauryldecahydronaphthalene carboxylic acid, stearyloctahydroindene carboxylic acid, palmitic acid, commercially available mixtures of two or more carboxylic acids such as tall oil acids, rosin acids, and the like.

A typical group of oil-soluble carboxylic acids useful in preparing the salts used in the present invention are the oil-soluble aromatic carboxylic acids. These acids are represented by the general formula:

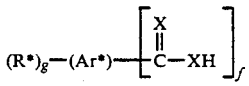

(IV)

wherein R* is an aliphatic hydrocarbon-based group of at least 4 carbon atoms, and no more than about 400 aliphatic carbon atoms, g is an integer from one to four, Ar* is a polyvalent aromatic hydrocarbon nucleus of up to about 14 carbon atoms, each X is independently a sulfur or oxygen atom, and f is an integer of from one to four with the proviso that R* and g are such that there is an average of at least 8 aliphatic carbon atoms provided by the R* groups for each acid molecule represented by Formula IV. Examples of aromatic nuclei represented by the variable Ar* are the polyvalent aromatic radicals derived from benzene, napthalene anthracene, phenanthrene, indene, fluorene, biphenyl, and the like. Generally, the radical represented by Ar* will be a polyvalent nucleus derived from benzene or naphthalene such as phenylenes and naphthylene, e.g., methyphenylenes, ethoxyphenylenes, nitrophenylenes, isopropylenes, hydroxyphenylenes, mercaptophenylenes, N,N-diethylaminophenylenes, chlorophenylenes, N,N-diethylaminophenylenes, chlorophenylenes, dipropoxynaphthylenes, triethylnaphthylenes, and similar tri-, tetra-, pentavalent nuclei thereof, etc.

The R* groups are usually hydrocarbyl groups, preferably groups such as alkyl or alkenyl radicals. However, the R* groups can contain small number substituents such as phenyl, cycloalkyl (e.g., cyclohexyl, cyclopentyl, etc.) and nonhydrocarbon groups such as nitro, amino, halo (e.g., chloro, bromo, etc.), lower alkoxy, lower alkyl mercapto, oxo substituents (i.e.,=O), thio groups (i.e.,=S), interrupting groups such as —NH—, —O—, —S—, and the like provided the essentially hydrocarbon character of the R* group is retained. The hydrocarbon character is retained for purposes of this invention so long as any non-carbon atoms present in the R* groups do not account for more than about 10% of the total weight of the R* groups.

Examples of R* groups include butyl, isobutyl, pentyl, octyl, nonyl, dodecyl, docosyl, tetracontyl, 5-chlorohexyl, 4-ethoxypentyl, 4-hexenyl, 3-cyclohexyloctyl, 4-(p-chlorophenyl)-octyl, 2,3,5-trimethylheptyl, 4-ethyl-5-methyloctyl, and substituents derived from polymerized olefins such as polychloroprenes, polyethylenes, polypropylenes, polyisobutylenes, ethylene-propylene copolymers, chlorinated olefin polymers, oxidized ethylene-propylene copolymers, and the like. Likewise, the group Ar* may contain non-hydrocarbon substituents, for example, such diverse substituents as lower alkoxy, lower alkyl mercapto, nitro, halo, alkyl or alkenyl groups of less than 4 carbon atoms, hydroxy, mercapto, and the like.

Another group of useful carboxylic acids are those of the formula:

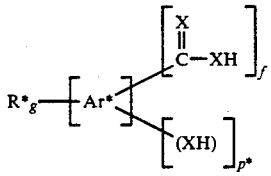

(V)

wherein R*, X, Ar*, f and g are as defined in Formula IV and p* is an integer of 1 to 4, usually 1 or 2. Within this group, an especially preferred class of oil-soluble carboxylic acids are those of the formula:

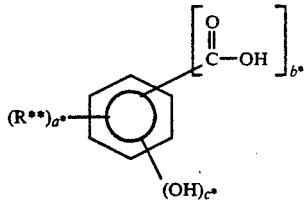

(VI)

wherein R** in Formula VI is an aliphatic hydrocarbon group containing at least 4 to about 400 carbon atoms, a* is an integer of from 1 to 3, b* is 1 or 2, c* is zero, 1, or 2 and preferably 1 with the proviso that R** and a* are such that the acid molecules contain at least an average of about 12 aliphatic carbon atoms in the aliphatic hydrocarbon substituents per acid molecule. And within this latter group of oil-soluble carboxylic acids, the aliphatic-hydrocarbon substituted salicyclic acids wherein each aliphatic hydrocarbon substituent contains an average of at least about 16 carbon atoms per substituent and 1 to 3 substituents per molecule are particularly useful. Salts prepared from such salicyclic acids wherein the aliphatic hydrocarbon substituents are derived from polymerized olefins, particularly polymerized lower 1-mono-olefins such as polyethylene, polypropylene, polyisobutylene, ethylene/-propylene copolymers and the like and having average carbon contents of about 30 to about 400 carbon atoms.

The carboxylic acids corresponding to Formulae IV-V above are well known or can be prepared according to procedures known in the art. Carboxylic acids of the type illustrated by the above formulae and processes for preparing their overbased metal salts are well known and disclosed, for example, in such U.S. Pat. Nos. as 2,197,832; 2,197,835; 2,252,662; 2,252,664; 2,714,092; 3,410,798 and 3,595,791 which are incorporated by reference herein for their disclosures of acids and methods of preparing overbased salts.

Another type of overbased carboxylate salt used in making (B-1) of this invention are those derived from alkenyl succinates of the general formula:

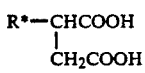

(VII)

wherein R* is as defined above in Formula IV. Such salts and means for making them are set forth in U.S. Pat. Nos. 3,271,130, 3,567,637 and 3,632,510, which are hereby incorporated by reference in this regard.

Other patents specifically describing techniques for making overbased salts of the hereinabove-described sulfonic acids, carboxylic acids, and mixtures of any two or more of these include U.S. Pat. Nos. 2,501,731; 2,616,904; 2,616,905; 2,616,906; 2,616,911; 2,616,924; 2,616,925; 2,617,049; 2,777,874; 3,027,325; 3,256,186; 3,282,835; 3,384,585; 3,373,108; 3,365,296; 3,342,733; 3,320,162; 3,312,618; 3,318,809; 3,471,403; 3,488,284; 3,595,790; and 3,629,109. The disclosures of these patents are hereby incorporated in this present specification for their disclosures in this regard as well as for their disclosure of specific suitable basic metal salts.

In the context of this invention, phenols are considered organic acids. Thus, overbased salts of phenols (generally known as phenates) are also useful in making (B-1) of this invention are well known to those skilled in the art. The phenols from which these phenates are formed are of the general formula:

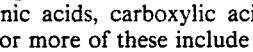

$(R^*)_g(Ar^*)—(XH)_f$ (VIII)

wherein R*, g, Ar*, X and f have the same meaning and preferences are described hereinabove with reference to Formula IV. The same examples described with respect to Formula IV also apply.

A commonly available class of phenates are those made from phenols of the general formula:

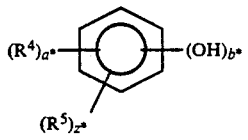

(IX)

wherein a* is an integer of 1–3, b* is of 1 or 2, z* is 0 or 1, $R^4$ in Formula IX is a hydrocarbyl-based substituent having an average of from 4 to about 400 aliphatic carbon atoms and $R^5$ is selected from the group consisting of lower hydrocarbyl, lower alkoxyl, nitro, amino, cyano and halo groups.

One particular class of phenates for use in this invention are the overbased, Group IIA metal sulfurized phenates made by sulfurizing a phenol as described hereinabove with a sulfurizing agent such as sulfur, a sulfur halide, or sulfide or hydrosulfide salt. Techniques for making these sulfurized phenates are described in U.S. Pat. Nos. 2,680,096; 3,036,971; and 3,775,321 which are hereby incorporated by reference for their disclosures in this regard.

Other phenates that are useful are those that are made from phenols that have been linked through alkylene (e.g., methylene) bridges. These are made by reacting single or multi-ring phenols with aldehydes or ketones, typically, in the presence of an acid or basic catalyst. Such linked phenates as well as sulfurized phenates are described in detail in U.S. Pat. No. 3,350,038; particularly columns 6–8 thereof, which is hereby incorporated by reference for its disclosures in this regard.

Generally Group IIA overbased salts of the above-described carboxylic acids are typically useful in making (B-1) of this invention.

Component (B-1) may also be a borated complex of an overboard metal sulfonate, carboxylates or phenate. Borated complexes of this type may be prepared by heating the overboard metal sulfonate, carboxylate or phenate with boric acid at about 50°–100° C., the number of equivalents of boric acid being roughly equal to the number of equivalents of metal in the salt.

The method of preparing metal overbased compositions in this manner is illustrated by the following examples.

EXAMPLE (B-1)-1

A mixture consisting essentially of 480 parts of a sodium petrosulfonate (average molecular weight of about 480), 84 parts of water, and 520 parts of mineral oil is heated at 100° C. The mixture is then heated with 86 parts of a 76% aqueous solution of calcium chloride and 72 parts of lime (90% purity) at 100° C. for two hours, dehydrated by heating to a water content of less than about 0.5%, cooled to 50° C., mixed with 130 parts of methyl alcohol, and then blown with carbon dioxide at 50° C. until substantially neutral. The mixture is then heated to 150° C. to distill off methyl alcohol and water and the resulting oil solution of the basic calcium sulfonate filtered. The filtrate is found to have a calcium sulfate ash content of and a metal ratio of 2.5. A mixture of 1305 parts of the above carbonated calcium petrosulfonate, 930 parts of mineral oil, 220 parts of methyl alcohol, 72 parts of isobutyl alcohol, and 38 parts of amyl alcohol is prepared, heated to 35° C., and subjected to the following operating cycle four times: mixing with 143 parts of 90% commercial calcium hydroxide (90% calcium hydroxide) and treating the mixture with carbon dioxide until it has a base number of 32–39. The resulting product is then heated to 155° C. during a period of nine hours to remove the alcohol and filtered at this temperature. The filtrate is characterized by a calcium sulfate ash content of about 40% and a metal ratio of about 12.2.

EXAMPLE (B-1)-2

A mineral oil solution of a basic, carbonated calcium complex is prepared by carbonating a mixture of an alkylated benzene sulfonic acid (molecular weight of 470) an alkylated calcium phenate, a mixture of lower alcohols (methanol, butanol, and pentanol) and excess lime (5.6 equivalents per equivalent of the acid). The solution has a sulfur content of 1.7%, a calcium content of 12.6% and a base number of 336. To 950 grams of the solution, there is added 50 grams of a polyisobutene (molecular weight of 1000)-substituted succinic anhydride (having a saponification number of 100) at 25° C. The mixture is stirred, heated to 150° C., held at that temperature for 0.5 hour, and filtered. The filtrate has a base number of 315 and contains 35.4% of mineral oil.

EXAMPLE (B-1)-3

To 950 grams of a solution of a basic, carbonated, calcium salt of an alkylated benzene sulfonic acid (average molecular weight - 425) in mineral oil (base number -406, calcium - 15.2% and sulfur - 1.4%) there is added 50 grams of the polyisobutenyl succinic anhydride of Example B-2 at 57° C. The mixture is stirred for 0.65 hour at 55°-57° C., then at 152°-153° C. for 0.5 hour and filtered at 105° C. The filtrate has a base number of 387 and contains 43.7% of mineral oil.

EXAMPLE (B-1)-4

A mixture comprising 753 parts (by weight) of mineral oil, 1440 parts of xylene, 84 parts of a mixture of a commercial fatty acid mixture (acid number of 200, 590 parts of an alkylated benzene sulfonic acid (average molecular weight - 500), and 263 parts of magnesium oxide is heated to 60° C. Methanol (360 parts) and water (180 parts) are added. The mixture is carbonated at 65° C.-98° C. while methanol and water are being removed by azeotropic distillation. Additional water (180 parts) is then added and carbonation is continued at 87°-90° C. for three and a half hours. Thereafter, the reaction mixture is heated to 160° C. at 20 torr and filtered at 160° C. to give a basic, carbonated magnesium sulfonate-carboxylate complex (78.1% yield) containing 7.69% of magnesium and 1.67% of sulfur and having a base number of 336. To 950 parts of the above basic, carbonated magnesium complex, there is added 50 parts of the polyisobutenyl complex, there is added 50 parts of the polyisobutenyl succinic anhydride of Example B-2 and the mixture is heated to 150° C. for one-half hour and then filtered to give a composition having a base number of 315.

EXAMPLE (B-1)-5

A mixture comprising 1000 grams (1.16 equivalents) of an oil solution of an alkylbenzene sulfonic acid, 115 grams of mineral oil, 97 grams of lower alcohols described in Example (B-1)-1, 57 grams of calcium hydroxide (1.55 equivalents), and a solution of 3.4 grams $CaCl_2$ in 7 grams water is reacted at a temperature of about 55° C. for about 1 hour. The product is stripped by heating to 165° C. at a pressure of 20 torr and filtered. The filtrate is an oil solution of a basic, carbonated calcium sulfonate complex having a metal ratio of 1.2 and containing 8.0% of calcium sulfate ash, 3.4% of sulfur and a base number of 10.

EXAMPLE (B-1)-6

A mixture of 2,576 grams of mineral oil, 240 grams (1.85 equivalents) of octyl alcohol, 740 grams (20.0 equivalents) of calcium hydroxide, 2304 grams (8 equivalents) of oleic acid, and 392 grams (12.3 equivalents) of methyl alcohol is heated with stirring to a temperature about 50° C. in about 0.5 hour. This mixture then is treated with $CO_2$ (3 cubic feet per hour) at 50°-60° C. for a period of about 3.5 hours. The resulting mixture is heated to 150° C. and filtered. The filtrate is a basic calcium oleate complex having the following analyses:
Sulfate ash (%) 24.1
Metal ratio 2.5
Neutralization No. (acidic) 2.0

EXAMPLE (B-1)-7

A reaction mixture comprising 1044 grams (about 1.5 equivalents) of an oil solution of an alkylphenyl sulfonic (average molecular weight −500), 1200 grams of mineral 981, 2400 grams of xylene, 138 grams (about 0.5 equivalents) of tall oil acid mixture (oil-soluble fatty acid mixture sold by Hercules under the name PAMAK-4), 434 grams (20 equivalents) of magnesium oxide, 600 grams of methanol, and 300 grams of water is carbonated at a rate of 6 cubic feet of carbon dioxide per hour at 65°-70° C. (methanol reflux). The carbon dioxide introduction rate was decreased as the carbon dioxide uptake diminished. After 2.5 hours of carbonation, the methanol is removed and by raising the temperature of the mixture to about 95° C. with continued carbon dioxide blowing at a rate of about two cubic feet per hour for one hour. Then 300 grams of water is added to the reaction mixture and carbonation was continued at about 90° C. (reflux) for about four hours. The material becomes hazy with the addition of the water but clarifies after 2-3 hours of continued carbonation. The carbonated product is then stripped to 160° C. at 20 torr and filtered. The filtrate is a concentrated oil solution (47.5% oil) of the desired basic magnesium salt, the salt being characterized by a metal ratio of about 10.

EXAMPLE (B-1)-8

Following the general procedure of Example (B-1)-7 but adjusting the weight ratio of methanol to water in the initial reaction mixture to 4:3 in lieu of the 2:1 ratio of Example (B-1)-7 another concentrated oil-solution (57.5% oil) of a basic magnesium salt is produced. This methanol-water ratio gives improved carbonation at the methanol reflux stage of carbonation and prevents thickening of the mixture during the 90° C. carbonation stage.

EXAMPLE (B-1)-9

A reaction mixture comprising 135 parts mineral oil, 30 parts xylene, 200 parts (0.235 equivalent) of a mineral oil solution of an alkylphenylsulfonic acid (average molecular weight - 425), 19 parts (0.068 equivalent) of the above-described mixture of tall oil acids, 60 parts (about 2.75 equivalents) of magnesium oxide, 83 parts methanol, and 62 parts water are carbonated at a rate of 15 parts of carbon dioxide per hour for about 2 hours at the methanol reflux temperature. The carbon dioxide inlet rate is then reduced to about 7 parts per hour and the methanol is removed by raising the temperature to about 98° C. over a 3 hour period. Then 47 parts of water are added and carbonation is continued for an additional 35. hours at a temperature of about 95° C.

The carbonated mixture is then stripped by heating to a temperature of 140°-145° C. over a 2.5 hour period. This results in an oil solution of a basic magnesium salt characterized by a metal ratio of about 10.

Then, the carbonated mixture is cooled to about 60°-65° C. and 208 parts xylene, 60 parts magnesium oxide, 83 parts methanol and 62 parts water are added thereto. Carbonation is resumed at a rate of 15 parts per hour for 2 hours at the methanol reflux temperature. The carbon dioxide addition rate is reduced to 7 parts per hour and the methanol is removed by raising the temperature to about 95° C. over a 3 hour period. An additional 41.5 parts of water are added and carbonation is continued at 7 parts per hour at a temperature of about 90°-95° C. for 3.5 hours. The carbonated mass is then heated to about 150°-160° C. over a 3.5-hour period and then further stripped by reducing the pressure to 20 torr at this temperature. The carbonated reaction product is then filtered. The filtrate is a concentrated oil-solution (31.6% oil) of the desired basic magnesium salt characterized by a metal ratio of 20.

EXAMPLE (B-1)-10

To a solution of 790 parts (1 equivalent) of an alkylated benzenesulfonic acid and 71 parts of polybutenyl succinic anhydride (equivalent weight about 560) containing predominantly isobutene units in 176 parts of mineral oil is added 320 parts (8 equivalents) of sodium hydroxide and 640 parts (20 equivalents) of methanol. The temperature of the mixture increases to 89° C. (reflux) over 10 minutes due to exotherming. During this period, the mixture is blown with carbon dioxide at 4 cfh. (cubic feet/hr.). Carbonation is continued for about 30 minutes as the temperature gradually decreases to 74° C. The methanol and other volatile materials are stripped from the carbonated mixture by blowing nitrogen through it at 2 cfh. while the temperature is slowly increased to 150° C. over 90 minutes. After stripping is completed, the remaining mixture is held at 155°-165° C. for about 30 minutes and filtered to yield an oil solution of the desired basic sodium sulfonate having a metal ratio of about 7.75. This solution contains 12.4% oil.

EXAMPLE (B-1)-11

Following the procedure of Example (B-1)-10, a solution of 780 parts (1 equivalent) of an alkylated benzenesulfonic acid and 119 parts of the polybutenyl succinic anhydride in 442 parts of mineral oil is mixed with 800 parts (20 equivalents) of sodium hydroxide and 704 parts (22 equivalents) of methanol. The mixture is blown with carbon dioxide at 7 cfh. for 11 minutes as the temperature slowly increases to 95° C. The rate of carbon dioxide flow is reduced to 6 cfh. and the temperature decreases slowly to 88° C. over about 40 minutes. The rate of carbon dioxide flow is reduced to 5 cfh. for about 35 minutes and the temperature slowly decreases to 73° C. The volatile materials are stripped by blowing nitrogen through the carbonated mixture at 2 cfh. for 105 minutes as the temperature is slowly increased to 160° C. After stripping is completed, the mixture is held at 160° C. for an additional 45 minutes and then filtered to yield an oil solution of the desired basic sodium sulfonate having a metal ratio of about 19.75. This solution contains 18.7% oil.

EXAMPLE (B-1)-12

Following the procedure of Example (B-1)-10 a solution of 780 parts (1 equivalent) of an alkylated benzenesulfonic acid and 86 parts of the polybutenyl succinic anhydride in 254 parts of mineral oil is mixed with 480 parts (12 equivalents) of sodium hydroxide and 640 parts (20 equivalents) of methanol. The reaction mixture is blown with carbon dioxide at 6 cfh. for about 45 minutes. During this time the temperature increases to 95° C. and then gradually decreases to 74° C. The volatile material is stripped by blowing with nitrogen gas at 2 cfh. for about one hour as the temperature is increased to 160° C. After stripping is complete the mixture is held at 160° C. for 0.5 hour and then filtered to yield an oil solution of the desired sodium salt, having a metal ratio of 11.8. The oil content of this solution is 14.7%.

EXAMPLE (B-1)-13

Following the procedure of Example (B-1)-10, a solution of 2800 parts (3.5 equivalents) of an alkylated benzenesulfonic acid and 302 parts of the polybutenyl succinic anhydride in 818 parts of mineral oil is mixed with 1680 parts (42 equivalents) of sodium hydroxide and 2240 parts (70 equivalents) of methanol. The mixture is blown with carbon dioxide for about 90 minutes at 10 cfh. During this period, the temperature increases to 96° C. and then slowly drops to 76° C. The volatile materials are stripped by blowing with nitrogen at 2 cfh. as the temperature is slowly increased from 76° C. to 165° C. by external heating. Water is removed by vacuum stripping. Upon filtration, an oil solution of the desired basic sodium salt is obtained. It has a metal ratio of about 10.8 and the oil content is 13.6%.

EXAMPLE (B-1)-14

Following the procedure of Example (B-1)-10 a solution of 780 parts (1.0 equivalent) of an alkylated benzenesulfonic acid and 103 parts of the polybutenyl succinic anhydride in 350 parts of mineral oil is mixed with 640 parts (16 equivalents of sodium hydroxide and 640 parts (20 equivalents) of methanol. This mixture is blown with carbon dioxide for about one hour at 6 cfh. During this period, the temperature increases to 95° C. and then gradually decreases to 75° C. The volatile material is stripped by blowing with nitrogen. During stripping, the temperature initially drops to 70° C. over 30 minutes and then slowly rises to 78° C. over 15 minutes. The mixture is then heated to 155° C. over 80 minutes. The stripped mixture is heated for an additional 30 minutes 15 155°-160° C. and filtered. The filtrate is an oil solution of the desired basic sodium sulfonate, having a metal ratio of about 15.2. It has an oil content of 17.1%.

EXAMPLE (B-1)-15

Following the procedure of Example (B-1)-10, a solution of 780 parts (1 equivalent) of an alkylated benzenesulfonic acid and 119 parts of the polybutenyl succinic anhydride in 442 parts of mineral oil is mixed well with 800 parts (10 equivalents) of sodium hydroxide and 640 parts (20 equivalents) of methanol. This mixture is blown with carbon dioxide for about 55 minutes at 8 cfh. During this period, the temperature of the mixture increases to 95° C. and then slowly decreases to 67° C. The methanol and water are stripped by blowing with nitrogen at 2 cfh. for about 40 minutes while the temperature is slowly increased to 160° C. After stripping, the temperature of the mixture is maintained at 160°-165° C. for about 30 minutes. The product is then filtered to give a solution of the corresponding sodium sulfonate having a metal ratio of about 16.8. This solution contains 18.7% oil.

EXAMPLE (B-1)-16

Following the procedure of Example (B-1)-10, 836 parts (1 equivalent) of a sodium petroleum sulfonate (sodium "Petronate") in an oil solution containing 48% oil and 63 parts of the polybutenyl succinic anhydride is heated to 60° C. and treated with 280 parts (7.0 equivalents) of sodium hydroxide and 320 parts (10 equivalents) of methanol. The reaction mixture is blown with carbon dioxide at 4 cfh. for about 45 minutes. During this time, the temperature increases to 85° C. and then slowly decreases to 74° C. The volatile material is stripped by blowing with nitrogen at 1 cfh. while the temperature is gradually increased to 160° C. After stripping is completed, the mixture is heated an additional 30 minutes at 160° C., and then is filtered to yield the sodium salt in solution. The product has a metal ratio of 8.0 and an oil content of 22.2%.

EXAMPLE (B-1)-17

To a mixture comprising 125 parts of low viscosity mineral oil and 66.5 parts of heptylphenol heated to about 38° C. there is added 3.5 parts of water. Thereafter, 16 parts of paraformaldehyde are added to the mixture at a uniform rate over 0.75 hour. Then 0.5 parts of hydrated lime are added and this mixture is heated to 80° C. over a 1 hour period. The reaction mixture thickens and the temperature rises to about 116° C. Then, 13.8 parts of hydrated lime are added over 0.75 hour while maintaining a temperature of about 80°-90° C. The material is then heated to about 140° C. for 6 to 7 hours at a reduced pressure of about 2-8 torr to remove substantially all water. An additional 40 parts of mineral oil are added to the reaction product and the resulting material is filtered. The filtrate is a concentrated oil solution (70% oil) of the substantially neutral calcium salt of the heptylphenol-formaldehyde condensation product. It is characterized by calcium content of about 2.2% and a sulfate ash content of 7.5%.

EXAMPLE (B-1)-18

A solution of 3192 parts (12 equivalents) of a polyisobutene-substituted phenol, wherein the polyisobutene substituent has a molecular weight of about 175, in 2400 parts of mineral is heated to 70° C. and 502 parts (12 equivalents) of solid sodium hydroxide is added. The material is blown with nitrogen at 162° C. under vacuum to remove volatiles and is then cooled to 125° C. and 465 parts (12 equivalents of 40% aqueous formaldehyde is added. The mixture is heated to 146° C. under nitrogen, and volatiles are finally removed again under vacuum. Sulfur dichloride, 618 parts (6 equivalents), is then added over hours. Water, 1000 parts, is added at 70° C. and the mixture is heated to reflux for 1 hour. All volatiles are then removed under vacuum at 155° C. and the residue is filtered at that temperature, with the addition of a filter aid material. The filtrate is the desired product (59% solution in mineral oil) containing 3.56% phenolic hydroxyl and 3.46% sulfur.

EXAMPLE (B-1)-19

A mixture of 319.2 parts (1.2 equivalents) of a tetrapropene-substituted phenol similar to that used in Example B-18, 240 parts of mineral oil and 45 parts (0.6 equivalent) of 40% aqueous formaldehyde solution is heated to 70° C., with stirring, and 100.5 parts (1.26 equivalents) of 50% aqueous sodium hydroxide is added over about 20 minutes, while the mixture is blown with nitrogen. Volatile materials are removed by stripping at 160° C., with nitrogen blowing and subsequently under vacuum. Sulfur dichloride, 61.8 parts (1.2 equivalents), is added below the surface of the liquid at 140°-150° C., over 6 hours. The mixture is then heated at 145° C. for one hour and volatile materials are removed by stripping under nitrogen at 160° C.

The intermediate thus obtained is filtered with the addition of a filter aid material, and 3600 parts (7.39 equivalents) thereof is combined with 1553 parts of mineral oil and 230 parts of the polyisobutenyl succinic anhydride of Example B-2. The mixture is heated to 67° C. and there are added 142 parts of acetic acid, 1248 parts of methanol and 602 parts (16.27. equivalents) of calcium hydroxide. The mixture is digested for a few minutes and then blown with carbon dioxide at 60°-65° C. The carbon dioxide-blown material is stripped at 160° C. to remove volatiles and finally filtered with the addition of a filter aid. The filtrate is the desired product containing 1.68% sulfur and 16.83% calcium sulfate ash.

EXAMPLE (B-1)-20

To a mixture of 3192 parts (12 equivalents) of tetrapropenyl-substituted phenol, 2400 parts of mineral oil and 465 parts (6 equivalents) of 40% aqueous formaldehyde at 82° C., is added, over 45 minutes, 960 equivalents) of 50% aqueous sodium hydroxide. Volatile materials are removed by stripping as in Example B-18, and to the residue is added 618 parts (12 equivalents) of sulfur dichloride over 3 hours. Toluene, 1000 parts, and 1000 parts of water are added and the mixture is heated under reflux for 2 hours. Volatile materials are then removed at 180° C. by blowing with nitrogen and the intermediate is filtered.

To 1950 parts (4 equivalents) of the intermediate thus obtained is added 135 parts of the polyisobutenyl succinic anhydride of Example B-2. The mixture is heated to 51° C., and 78 parts of acetic acid and 431 parts of methanol are added, followed by 325 parts (8.8 equivalents) of calcium hydroxide. The mixture is blown with carbon dioxide and is finally stripped with nitrogen blowing at 158° C. and filtered while hot, using a filter aid. The filtrate is a 68% solution in mineral oil of the desired product and contains 2.63% sulfur and 22.99% calcium sulfate ash.

EXAMPLE (B-1)-21

A reaction mixture comprising about 512 parts by weight of a mineral oil solution containing about 0.5 equivalent of a substantially neutral magnesium salt of an alkylated salicylic acid wherein the alkyl group has an average of about 18 aliphatic carbon atoms and about 30 parts by weight of an oil mixture containing about 0.037 equivalent of an alkylated benzenesulfonic acid together with about 15 parts by weight (about 0.65 equivalent) of a magnesium oxide and about 250 parts by weight of xylene is added to a flask and heated to a temperature of about 60° C. to 70° C. The reaction mass is subsequently heated to about 85° C. and approximately 60 parts by weight of water are added. The reaction mass is held at a reflux temperature of about 95° C. to 100° C. for about 1½ hours and subsequently stripped at a temperature of 155° C-160° C., under a vacuum, and filtered. The filtrate comprises the basic carboxylic magnesium salt characterized by a sulfated ash content of 12.35% (ASTM D-874, IP 163), indicating that the salt contains 200% of the stoichiometrically equivalent amount of magnesium.

EXAMPLE (B-1)-22

A reaction mixture comprising about 506 parts by weight of a mineral oil solution containing about 0.5 equivalent of a substantially neutral magnesium salt of an alkylated salicylic acid wherein the alkyl groups have an average of about 16 to 24 aliphatic carbon atoms and about 30 parts by weight of an oil mixture containing about 0.037 equivalent of an alkylate benzenesulfonic acid together with about 22 parts by weight (about 1.0 equivalent) of a magnesium oxide and about 250 parts by weight of xylene is added to a flask and heated to temperatures of about 60° C. to 70° C. The reaction is subsequently heated to about 85° C. and approximately 60 parts by weight of water are added to the reaction mass which is then heated to the reflux temperature. The reaction mass is held at the reflux temperature of about 95°-100° C. for about 1½ hours and subsequently stripped at about 155° C., under 40 torr and filtered. The filtrate comprises the basic carboxylic magnesium salts and is characterized by a sulfated ash content of 15.59% (sulfated ash) corresponding to 274% of the stoichiometrically equivalent amount.

EXAMPLE (B-1)-23

A substantially neutral magnesium salt of an alkylated salicylic acid wherein the alkyl groups have from 16 to 24 aliphatic carbon atoms is prepared by reacting approximately stoichiometric amounts of magnesium chloride with a substantially neutral potassium salt of said alkylated salicylic acid. A reaction mass comprising approximately 6580 parts by weight of a mineral oil solution containing about 6.50 equivalents of said substantially neutral magnesium salt of the alkylated salicylic acid and about 388 parts by weight of an oil mixture containing about 0.48 equivalent of an alkylated benzenesulfonic acid together with approximately 285 parts by weight (14 equivalents) of a magnesium oxide and approximately 3252 parts by weight of xylene is added to a flask and heated to temperatures of about 55° C. to 75° C. The reaction mass is then heated to about 82° C. and approximately 780 parts by weight of water are added to the reaction which is subsequently heated to the reflux temperature. The reaction mass is held at the reflux temperature of about 95°-100° C. for about 1 hour and subsequently stripped at a temperature of about 170° C., under 50 torr and filtered. The filtrate comprises the basic carboxylic magnesium salts and has a sulfated ash content of 15.7% (sulfated ash) corresponding to 276% of the stoichiometrically equilvalent amount.

(B-2) Carboxylic Dispersant Composition

The composition of the present invention comprises (B-2) at least one carboxylic dispersant characterized by the presence within its molecular structure of (i) at least one polar group selected from acyl, acyloxy or hydrocarbylimidoyl groups, and (ii) at least one group in which a nitrogen or oxygen atom is attached directly to said group (i), and said nitrogen or oxygen atom also is attached to a hydrocarbyl group. The structures of the polar group (i), as defined by the International Union of Pure and Applied Chemistry, are as follows ($R^6$ representing a hydrocarbon or similar group):

Acyl: $R^6-\overset{\overset{\displaystyle O}{\|}}{C}-$

Acyloxy: $R^6-\overset{\overset{\displaystyle O}{\|}}{C}-O-$

Hydrocarbylimidoyl: $R^6-\overset{\overset{\displaystyle NR}{\|}}{C}-$

Group (ii) is preferably at least one group in which a nitrogen or oxygen atom is attached directly to said polar group, said nitrogen or oxygen atom also being attached to a hydrocarbon group or substituted hydrocarbon group, especially an amino, alkylamino-, polyalkyleneamino-, hydroxy- or alkyleneoxy-substituted hydrocarbon group. With respect to group (ii), the dispersants are conveniently classified as "nitrogen-bridged dispersants" and "oxygen-bridged dispersants" wherein the atom attached directly to polar group (i) is nitrogen or oxygen, respectively.

Generally, the carboxylic dispersants can be prepared by the reaction of a hydrocarbon-substituted succinic acid-producing compound (herein sometimes referred to as the "succinic acylating agent") with at least about one-half equivalent, per equivalent of acid-producing compound, of an organic hydroxy compound, or an amine containing at least one hydrogen attached to a nitrogen group, or a mixture of said hydroxy compound and amine. The carboxylic dispersants (B-2) obtained in this manner are usually complex mixtures whose precise composition is not readily identifiable. The nitrogen-containing carboxylic dispersants are sometimes referred to herein as "acylated amines". The compositions obtained by reaction of the acylating agent and alcohols are sometimes referred to herein as "carboxylic ester" dispersants. The carboxylic dispersants (B-2) are either oil-soluble, or they are soluble in the oil-containing lubricating and functional fluids of this invention.

The soluble nitrogen-containing carboxylic dispersants useful as component (B-2) in the compositions of the present invention are known in the art and have been described in many U.S. Pat. Nos. including U.S. Pat. No. 3,172,892
U.S. Pat. No. 3,341,542
U.S. Pat. No. 3,630,904
U.S. Pat. No. 3,219,666
U.S. Pat. No. 3,444,170
U.S. Pat. No. 3,787,374
U.S. Pat. No. 3,272,746
U.S. Pat. No. 3,454,607
U.S. Pat. No. 4,234,435
U.S. Pat. No. 3,316,177
U.S. Pat. No. 3,541,012

The carboxylic ester dispersants useful as (B-2) also have been described in the prior art. Examples of patents describing such dispersants include U.S. Pat. Nos. 3,381,022; 3,522,179; 3,542,678; 3,957,855; and 4,034,038. Carboxylic dispersants prepared by reaction of acylating agents with alcohols and amines or amino alcohols are described in, for example, U.S. Pat. Nos. 3,576,743 and 3,632,511.

The above U.S. patents are expressly incorporated herein by reference for their teaching of the preparation of carboxylic dispersants useful as component (B-2)

In general, a convenient route for the preparation of the nitrogen-containing carboxylic dispersants (B-2)

comprises the reaction of a hydrocarbon-substituted succinic acid-producing compound ("carboxylic acid acylating agent") with an amine containing at least one hydrogen attached to a nitrogen atom (i.e., H—N<). The hydrocarbon-substituted succinic acid-producing compounds include the succinic acids, anhydrides, halides and esters. The number of carbon atoms in the hydrocarbon substituent on the succinic acid-producing compound may vary over a wide range provided that the nitrogen-containing composition (B-2) is soluble in the lubricating compositions of the present invention. Thus, the hydrocarbon substituent generally will contain an average of at least about 30 aliphatic carbon atoms and preferably will contain an average of at least about 50 aliphatic carbon atoms. In addition to the oil-solubility considerations, the lower limit on the average number of carbon atoms in the substituent also is based upon the effectiveness of such compounds in the lubricating oil compositions of the present invention. The hydrocarbyl substituent of the succinic compound may contain polar groups as indicated above, and, providing that the polar groups are not present in proportion sufficiently large to significantly alter the hydrocarbon character of the substituent.

The sources of the substantially hydrocarbon substituent include principally the high molecular weight substantially saturated petroleum fractions and substantially saturated olefin polymers, particularly polymers of mono-olefins having from 2 to 30 carbon atoms. The especially useful polymers are the polymers of 1-monoolefins such as ethylene, propene, 1-butene, isobutene, 1-hexene, 1-octene, 2-methyl-1-heptene, 3-cyclohexyl-1-butene, and 2-methyl-5-propyl-1-hexene. Polymers of medial olefins, i.e., olefins in which the olefinic linkage is not at the terminal position, likewise are useful. They are illustrated by 2-butene, 2-pentene, and 4-octene.

Also useful are the interpolymers of the olefins such as those illustrated above with other interpolymerizable olefinic substances such as aromatic olefins, cyclic olefins, and polyolefins. Such interpolymers include, for example, those prepared by polymerizing isobutene with styrene; isobutene with butadiene; propene with isoprene, ethylene with piperylene; isobutene with chloroprene; isobutene with p-methyl styrene; 1-hexene with 1,3-hexadiene; 1-octene with 1-hexene; 1-heptene with 1-pentene; 3-methyl-1-butene with 1-octene; 3,3-dimethyl-1-pentene with 1-hexene; isobutene with styrene and piperylene; etc.

The relative proportions of the mono-olefins to the other monomers in the interpolymers influence the stability and oil-solubility of the final products derived from such interpolymers. Thus, for reasons of oil-solubility and stability the interpolymers contemplated for use in this invention should be substantially aliphatic and substantially saturated, i.e., they should contain at least about 80%, preferably at least about 95%, on a weight basis of units derived from the aliphatic mono-olefins and no more than about 5% of olefinic linkages based on the total number of carbon-to-carbon covalent linkages. In most instances, the percentage of olefinic linkages should be less than about 2% of the total number of carbon-to-carbon covalent linkages.

Specific examples of such interpolymers include copolymer of 95% (by weight) of isobutene with 5% of styrene; terpolymer of 98% of isobutene with 1% of piperylene and 1% of chloroprene; terpolymer of 95% of isobutene with 2% of 1-butene and 3% of 1-hexene, terpolymer of 80% of isobutene with 20% of 1-pentene and 20% of 1-octene; copolymer of 800% of 1-hexene and 20% of 1-heptene; terpolymer of 90% of isobutene with 2% of cyclohexene and 8% of propene; and copolymer of 80% of ethylene and 20% of propene.

Another source of the substantially hydrocarbon group comprises saturated aliphatic hydrocarbons such as highly refined high molecular weight white oils or synthetic alkanes such as are obtained by hydrogenation of high molecular weight olefin polymers illustrated above or high molecular weight olefin polymers illustrated above or high molecular weight olefinic substances.

The use of olefin polymers having molecular weights (Mn) of about 700–10,000 is preferred. Higher molecular weight olefin polymers having molecular weights (Mn) from about 10,000 to about 100,000 or higher have been found to impart also viscosity index improving properties to the final products of this invention. The use of such higher molecular weight olefin polymers often is desirable. Preferably the substituent is derived from a polyolefin characterized by an Mn value of about 700 to about 10,000, and an Mw/Mn value of 1.0 to about 4.0.

In preparing the substituted succinic acylating agents of this invention, one or more of the above-described polyalkenes is reacted with one or more acidic reactants selected from the group consisting of maleic or fumaric reactants such as acids or anhydrides. Ordinarily the maleic or fumaric reactants will be maleic acid, fumaric acid, maleic anhydride, or a mixture of two or more of these. The maleic reactants are usually preferred over the fumaric reactants because the former are more readily available and are, in general, more readily reacted with the polyalkenes (or derivatives thereof) to prepare the substituted succinic acid-producing compounds useful in the present invention. The especially preferred reactants are maleic acid, maleic anhydride, and mixtures of these. Due to availability and ease of reaction, maleic anhydride will usually be employed.

For convenience and brevity, the term "maleic reactant" is often used hereinafter. When used, it should be understood that the term is generic to acidic reactants selected from maleic and fumaric reactants including a mixture of such reactants. Also, the term "succinic acylating agents" is used herein to represent the substituted succinic acid-producing compounds.

One procedure for preparing the substituted succinic acylating agents useful in this invention is illustrated, in part, in U.S. Pat. No. 3,219,666 which is expressly incorporated herein by reference for its teachings in regard to preparing succinic acylating agents. This procedure is conveniently designated as the "two-step procedure". It involves first chlorinating the polyalkene until there is an average of at least about one chloro group for each molecular weight of polyalkene. (For purposes of this invention, the molecular weight of the polyalkene is the weight corresponding to the Mn value.) Chlorination involves merely contacting the polyalkene with chlorine gas until the desired amount of chlorine is incorporated into the chlorinated polyalkene. Chlorination is generally carried out at a temperature of about 75° C. to about 125° C. If a diluent is used in the chlorination procedure, it should be one which is not itself readily subject to further chlorination. Poly- and perchlorinated and/or fluorinated alkanes and benzenes are examples of suitable diluents.

The second step in the two-step chlorination procedure, for purposes of this invention, is to react the chlorinated polyalkene with the maleic reactant at a temperature usually within the range of about 100° C. to about 200° C. The mole ratio of chlorinated polyalkene to maleic reactant is usually about 1:1. (For purposes of this invention, a mole of chlorinated polyalkene is that weight of chlorinated polyalkene corresponding to the Mn value of the unchlorinated polyalkene.) However, a stoichiometric excess of maleic reactant can be used, for example, a mole ratio of 1:2. If an average of more than about one chloro group per molecule of polyalkene is introduced during the chlorination step, then more than one mole of maleic reactant can react per molecule of chlorinated polyalkene. Because of such situations, it is better to describe the ratio of chlorinated polyalkene to maleic reactant in terms of equivalents. (An equivalent weight of chlorinated polyalkene, for purposes of this invention, is the weight corresponding to the Mn value divided by the average number of chloro groups per molecule of chlorinated polyalkene while the equivalent weight of a maleic reactant is its molecular weight.) Thus, the ratio of chlorinated polyalkene to maleic reactant will normally be such as to provide about one equivalent of maleic reactant for each mole of chlorinated polyalkene up to about one equivalent of maleic reactant for each equivalent of chlorinated polyalkene with the understanding that it is normally desirable to provide an excess of maleic reactant; for example, an excess of about 5% to about 25% by weight. Unreacted excess maleic reactant may be stripped from the reaction product, usually under vacuum, or reacted during a further stage of the process as explained below.

The resulting polyalkene-substituted succinic acylating agent is, optionally, again chlorinated if the desired number of succinic groups are not present in the product. If there is present, at the time of this subsequent chlorination, any excess maleic reactant from the second step, the excess will react as additional chlorine is introduced during the subsequent chlorination. Otherwise, additional maleic reactant is introduced during and/or subsequent to the additional chlorination step. This technique can be repeated until the total number of succinic groups per equivalent weight of substituent groups reaches the desired level.

Another procedure for preparing substituted succinic acid acylating agents useful in this invention utilizes a process described in U.S. Pat. No. 3,912,764 and U.K. Patent 1,440,219, both of which are expressly incorporated herein by reference for their teachings in regard to that process. According to that process, the polyalkene and the maleic reactant are first reacted by heating them together in a "direct alkylation" procedure. When the direct alkylation step is completed, chlorine is introduced into the reaction mixture to promote reaction of the remaining unreacted maleic reactants. According to the patents, 0.3 to 2 or more moles of maleic anhydride are used in the reaction for each mole of olefin polymer; i.e., polyalkylene. The direct alkylation step is conducted at temperatures of 180°-250° C. During the chlorine-introducing stage, a temperature of 160°-225° C. is employed. In utilizing this process to prepare the substituted succinic acylating agents of this invention, it would be necessary to use sufficient maleic reactant and chlorine to incorporate at least 1.3 succinic groups into the final product for each equivalent weight of polyalkene.

Another process for preparing the substituted succinic acylating agents of this invention is the socalled "one-step" process. This process is described in U.S. Pat. Nos. 3,215,707 and 3,231,587. Both are expressly incorporated herein by reference for their teachings in regard to that process.

Basically, the one-step process involves preparing a mixture of the polyalkene and the maleic preparing a mixture of the polyalkene and the maleic reactant containing the necessary amounts of both to provide the desired substituted succinic acylating agents of this invention. This means that there must be at least one mole of maleic reactant for each mole of polyalkene in order that there can be at least one succinic group for each equivalent weight of substituent groups. Chlorine is then introduced into the mixture, usually by passing chlorine gas through the mixture with agitation, while maintaining a temperature of at least about 140° C.

A variation of this process involves adding additional maleic reactant during or subsequent to the chlorine introduction but, for reasons explained in U.S. Pat. Nos. 3,215,707 and 3,231,587, this variation is presently not as preferred as the situation where all the polyalkene and all the maleic reactant are first mixed before the introduction of chlorine.

Usually, where the polyalkene is sufficiently fluid at 140° and above, there is no need to utilize an additional substantially inert, normally liquid solvent/diluent in the one-step process. However, as explained hereinbefore, if a solvent/diluent is employed, it is preferably one that resists chlorination. Again, the poly- and perchlorinated and/or -fluorinated alkanes, cycloalkanes, and benzenes can be used for this purpose.

Chlorine may be introduced continuously or intermittently during the one-step process. The rate of introduction of the chlorine is not critical although, for maximum utilization of the chlorine, the rate should be about the same as the rate of consumption of chlorine in the course of the reaction. When the introduction rate of chlorine exceeds the rate of consumption, chlorine is evolved from the reaction mixture. It is often advantageous to use a closed system, including superatmospheric pressure, in order to prevent loss of chlorine so as to maximize chlorine utilization.

The minimum temperature at which the reaction in the one-step process takes place at a reasonable rate is about 140° C. thus, the minimum temperature at which the process is normally carried out is in the neighborhood of 140° C. the preferred temperature range is usually between about 160°-220° C. Higher temperatures such as 250° C. or even higher may be used but usually with little advantage. In fact, temperatures in excess of 220° C. are often disadvantageous with respect to preparing the particular acylated succinic compositions of this invention because they tend to "crack" the polyalkenes (that is, reduce their molecular weight by thermal degradation) and/or decompose the maleic reactant. For this reason, maximum temperatures of about 200°-210° C. are normally not exceeded. The upper limit of the useful temperature in the one-step process is determined primarily by the decomposition point of the components in the reaction mixture including the reactants and the desired products. The decomposition point is that temperature at which there is sufficient decomposition of any reactant or product such as to interfere with the production of the desired products.

In the one-step process, the molar ratio of maleic reactant to chlorine is such that there is at least about one mole of chlorine for each mole of maleic reactant to be incorporated into the product. Moreover, for practical reasons, a slight excess, usually in the neighborhood of about 5% to about 30% by weight of chlorine, is utilized in order to offset any loss of chlorine from the reaction mixture. Larger amounts of excess chlorine may be used but do not appear to produce any beneficial results.

The molar ratio of polyalkene to maleic reactant preferably is such that there is at least about one mole of maleic reactant for each mole of polyalkene. This is necessary in order that there can be at least 1.0 succinic group per equivalent weight of substituent group in the product. Preferably, however, an excess of maleic reactant is used. Thus, ordinarily about 5% to about 25% excess of maleic reactant will be used relative to that amount necessary to provide the desired number of succinic groups in the product.

The amines which are reacted with the succinic acid-producing compounds to form the nitrogen-containing compositions (B-2) may be monoamines and polyamines. The monoamines and polyamines must be characterized by the presence within their structure of at least one H—H<group. Therefore, they have at least one primary (i.e., $H_2N$—) or secondary amino (i.e., 1 H—N<) group. The amines can be aliphatic, cycloaliphatic, aromatic, or heterocyclic, including aliphatic-substituted cycloaliphatic, aliphatic-substituted aromatic, aliphatic-substituted heterocyclic, cycloaliphatic-substituted aliphatic, cycloaliphatic substituted aromatic, cycloaliphatic-substituted heterocyclic, aromatic-substituted aliphatic, aromatic-substituted cycloaliphatic, aromatic-substituted heterocyclic-substituted alicyclic, and heterocyclic-substituted aromatic amines and may be saturated or unsaturated. The amines may also contain non-hydrocarbon substituents or groups as long as these groups do not significantly interfere with the reaction of the amines with the acylating reagents of this invention. Such non-hydrocarbon substituents or groups include lower alkoxy, lower alkyl mercapto, nitro, interrupting groups such as —O—and —S—(e.g., as in such groups as —$CH_2CH_2$—X—$CH_2CH_2$—where X is —O—or —S—). In general, the amine of (B-2) may be characterized by the formula $$T^7R^8NH$$

wherein $R^7$ and $R^8$ are each independently hydrogen or hydrocarbon, amino-substituted hydrocarbon, hydroxy-substituted hydrocarbon, alkoxy-substituted hydrocarbon, amino, carbamyl, thiocarbamyl, guanyl and acylimidoyl groups provided that only one of $R^7$ and $R^8$ may be hydrogen.

With the exception of the branched polyalkylene polyamine, the polyoxyalkylene polyamines, and the high molecular weight hydrocarbyl-substituted amines described more fully hereafter, the amines ordinarily contain less than about 40 carbon atoms in total and usually not more than about 20 carbon atoms in total.

Aliphatic monoamines include mono-aliphatic and dialiphatic substituted amines wherein the aliphatic groups can be saturated or unsaturated and straight or branched chain. Thus, they are primary or secondary aliphatic amines. Such amines include, for example, mono- and dialkyl-substituted amines, mono- and dialkenyl-substituted amines, and amines having one N-alkenyl substituent and one N-alkyl substituent and the like. The total number of carbon atoms in these aliphatic monoamines will, as mentioned before, normally not exceed about 40 and usually not exceed about 20 carbon atoms. Specific examples of such monoamines include ethylamine, diethylamine, n-butylamine, di-n-butylamine, allylamine, isobutylamine, cocoamine, stearylamine, laurylamine, methyllaurylamine, oleyl-amine, N-methyl-octylamine, dodecylamine, octadecylamine, and the like. Examples of cycloaliphatic-substituted aliphatic amines, aromatic-substituted aliphatic amines, and heterocyclic-substituted aliphatic amines, include 2-(cyclohexyl)-ethylamine, benzylamine, phenethylamine, and 3-(furylpropyl) amine.

Cycloaliphatic monoamines are those monoamines wherein there is one cycloaliphatic substituent attached directly to the amino nitrogen through a carbon atom in the cyclic ring structure. Examples of cycloaliphatic monoamines include cyclohexylamines, cyclopentylamines, cyclohexenylamines, cyclopentenylamines, N-ethyl-cyclohexylamine, dicyclohexylamines, and the like. Examples of aliphatic-substituted, aromatic-substituted, and heterocyclic-substituted cycloaliphatic monoamines include propyl-substituted cyclohexylamines, phenyl-substituted cyclopentylamines, and pyranyl-substituted cyclohexylamine.

Aromatic amines include those monoamines wherein a carbon atom of the aromatic ring structure is attached directly to the amino nitrogen. The aromatic ring will usually be a mononuclear aromatic ring (i.e., one derived from benzene) but can include fused aromatic rings, especially those derived from naphthalene. Examples of aromatic monoamines include aniline, di-(paramethylphenyl)amine, naphthylamine, N-N-butyl)-aniline, and the like. Examples of aliphatic-substituted, cycloaliphatic-substituted, and heterocyclic-substituted aromatic monoamines are para-ethoxy-aniline, paradodecylaniline, cyclohexyl-substituted naphthylamine, and thienyl-substituted aniline.

The polyamines from which (B-2) is derived include principally alkylene amines conforming for the most part to the formula

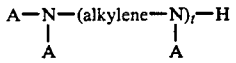

wherein t is an integer preferably less than about 10, A is a hydrogen group or a substantially hydrocarbon group preferably having up to about 30 carbon atoms, and the alkylene group is preferably a lower alkylene group having less than about 8 carbon atoms. The alkylene amines include principally methylene amines, ethylene amines, hexylene amines, heptylene amines, octylene amines, other polymethylene amines. They are exemplified specifically by: ethylene diamine, triethylene tetramine, propylene diamine, decamethylene diamine, octamethylene diamine, di(heptamethylene) triamine, tripropylene tetramine, tetraethylene pentamine, trimethylene diamine, pentaethylene hexamine, di(-trimethylene) triamine. Higher homologues such as are obtained by condensing two or more of the above-illustrated alkylene amines likewise are useful.

The ethylene amines are especially useful. They are described in some detail under the heading "Ethylene Amines" in Encyclopedia of Chemical Technology, Kirk and Othmer, Vol. 5, pp. 898–905, Interscience Publishers, New York (1950). Such compounds are prepared most conveniently by the reaction of an alkylene chloride with ammonia. The reaction results in the production of somewhat complex mixtures of alkylene amines, including cyclic condensation products such as piperazines. These mixtures find use in the process of this invention. On the other hand, quite satisfactory products may be obtained also by the use of pure alkylene amines. An especially useful alkylene amine for reasons of economy as well as effectiveness of the products derived therefrom is a mixture of ethylene amines prepared by the reaction of ethylene chloride and ammonia and having a composition which corresponds to that of tetraethylene pentamine.

Hydroxyalkyl-substituted alkylene amines, i.e., alkylene amines having one or more hydroxyalkyl substituents on the nitrogen atoms, likewise are contemplated for use herein. The hydroxyalkyl-substituted alkylene amines are preferably those in which the alkyl group is a lower alkyl group, i.e., having less than about 6 carbon atoms. Examples of such amines include N-(2-hydroxyethyl)ethylene diamine, N, N'-bis(2-hydroxy-ethyl)-ethylene diamine, 1 -(2-hydroxyethyl)piperazine, monohydroxypropyl)piperazine, di-hydroxypropyl-substituted tetraethylene pentamine, N-(3-hydroxypropyl)-tetramethylene diamine, and 2-heptadecyl-1-(2-hydroxy-ethyl)-imidazoline.

Higher homologues such as are obtained by condensation of the above illustrated alkylene amines or hydroxy alkyl-substituted alkylene amines through amino radicals or through hydroxy radicals are likewise useful. It will be appreciated that condensation through amino radicals results in a high amine accompanied with removal of ammonia and that condensation through the hydroxy radicals results in products containing ether linkages accompanied with removal of water.

Heterocyclic mono- and polyamines can also be used in making the nitrogen-containing compositions (B-2). As used herein, the terminology "heterocyclic mono- and polyamine(s)" is intended to describe those heterocyclic amines containing at least one primary secondary amino group and at least one nitrogen as a heteroatom in the heterocyclic ring. However, as long as there is present in the heterocyclic mono- and polyamines at least one primary or secondary amino group, the hetero-N atom in the ring can be a tertiary amino nitrogen; that is, one that does not have hydrogen attached directly to the ring nitrogen. Heterocyclic amines can be saturated or unsaturated and can contain various substituents such as nitro, alkoxy, alkyl mercapto, alkyl, alkenyl, aryl, alkaryl, or aralkyl substituents. Generally, the total number of carbon atoms in the substituents will not exceed about 20. Heterocyclic amines can contain hetero atoms other than nitrogen, especially oxygen and sulfur. Obviously they can contain more than one nitrogen hetero atom. The 5- and 6-membered heterocyclic rings are preferred.

Among the suitable heterocyclics are aziridines, azetidines, azolidines, tetra- and di-hydro pydridines, pyrroles, indoles, piperidines, imidazoles, di- and tetrahydroimidazoles, piperazines, isoindoles, purines, morpholines, thiomorpholines, N-aminoalkylmorpholines, N-aminoalkylthiomorpholines, N-aminoalkylpiperazines, N,N'-di-aminoalkylpiperazines, azepines, azocines, azonines, azecines and tetra-, di- and perhydro deriyatives of each of the above and mixtures of two or more of these heterocyclic amines. Preferred heterocyclic amines are the saturated 5- and 6-membered heterocyclic amines containing only nitrogen, oxygen and/or sulfur in the hetero ring, especially the piperidines, piperazines, thiomorpholines, morpholines, pyrrolidines, and the like. Piperidine, aminoalkyl-substituted piperidines, piperazine, aminoalkyl-substituted piperazines, morpholine, aminoalkyl-substituted morpholines, pyrrolidine, and aminoalkyl-substituted pyrrolidines, are especially preferred. Usually the aminoalkyl substituents are substituted on a nitrogen atom forming part of the hetero ring. Specific examples of such heterocyclic amines include N-aminiopropylmorpholine, N-aminoethylpiperazine, and N,N'-di-aminoethylpiperazine.

The nitrogen-containing composition (B-2) obtained by reaction of the succinic acid-producing compounds and the amines described above may be amine salts, amides, imides, imidazolines as well as mixtures thereof. To prepare the nitrogen-containing composition (B-2), one or more of the succinic acid-producing compounds and one or more of the amines are heated, optionally in the presence of a normally liquid, substantially inert organic liquid solvent/diluent at an elevated temperature generally in the range of from about 80° C. up to the decomposition point of the mixture or the product. Normally, temperatures in the range of about 100° C. up to about 300° C. are utilized provided that 300° C. does not exceed the decomposition point.

The succinic acid-producing compound and the amine are reacted in amounts sufficient to provide at least about one-half equivalent, per equivalent of acid-producing compound, of the amine. Generally, the maximum amount of amine present will be about 2 moles of amine per equivalent of succinic acid-producing compound. For the purposes of this invention, an equivalent of the amine is that amount of the amine corresponding to the total weight of amine divided by the total number of nitrogen atoms present. Thus, octyl amine has an equivalent weight equal to its molecular weight; ethylene diamine has an equivalent weight equal to one-half its molecular weight; and aminoethyl piperazine has an equivalent weight equal to one-third its molecular weight. The number of equivalents of succinic acid-producing compound will vary with the number of succinic groups present therein, and generally, there are two equivalents of acylating reagent for each succinic group in the acylating reagents. Conventional techniques may be used to determine the number of carboxyl functions (e.g., acid number, saponification number) and, thus, the number of equivalents of acylating reagent available to react with amine. Additional details and examples of the procedures for preparing the nitrogen-containing compositions of the present invention by reaction of succinic acid-producing compounds and amines are included in, for example, U.S. Pat. Nos. 3,172,892; 3,219,666; 3,272,746; and 4,234,435, the disclosures of which are hereby incorporated by reference.

Oxygen-bridged dispersants comprise the esters of the above-described carboxylic acids, as described (for example) in the aforementioned U.S. Pat. No. 3,381,022 and 3,542,678. As such, they contain acyl or occasionally, acylimidoyl groups. (An oxygen-bridged dispersant containing an acyloxy group as the polar group would be a peroxide, which is unlikely to be stable under all conditions of use of the compositions of this invention.) These esters are preferably prepared by conventional methods, usually the reaction (frequently in the presence of an acidic catalyst) of the carboxylic acid-producing compound with an aromatic compound such as a phenol or naphthol. The preferred hydroxy compounds are alcohols containing up to about 40 aliphatic carbon atoms. These may be monohydric alcohols such as methanol, ethanol, isooctanol, dodecanol, cyclohexanol, neopentyl alcohol, monomethyl ester of ethylene glycol and the like, or polyhydric alcohols including ethylene glycol, diethylene glycol, dipropylene glycol, tetramethylene glycol, pentaerythritol, tris-(hydroxymethyl)aminomethane (THAM), glycerol and the like. Carbohydrates (e.g., sugars, starches, cellulose) are also suitable as are partially esterified derivatives of polyhydric alcohols having at least three hydroxy groups.

The reaction is usually effected at a temperature above about 100° C. and typically at 150°-300° C. the esters may be neutral or acidic, or may contain unesterified hydroxy groups, according as the ratio or equivalents of acid-producing compound to hydroxy compound is equal to, greater than or less than 1:1.

As will be apparent, the oxygen-bridged dispersants are normally substantially neutral or acidic. They are among the preferred ester dispersants for the purposes of this invention.

It is possible to prepare mixed oxygen- and nitrogen-bridged dispersants by reacting the acylating agent simultaneously or, preferably, sequentially with nitrogen-containing and hydroxy reagents may be between about 10:1 and 1:10, on an equivalent weight basis. The methods of preparation of the mixed oxygen- and nitrogen-bridged dispersants are generally the same as for the individual dispersants described, except that two sources of group (ii) are used. As previously noted, substantially neutral or acidic dispersants are preferred, and a typical method of producing mixed oxygen- and nitrogen-bridged dispersants of this type (which are especially preferred) is to react the acylating agent with the hydroxy reagent first and subsequently react the intermediate thus obtained with a suitable nitrogen-containing reagent in an amount to afford a substantially neutral or acid product.

The following examples are illustrative of the process for preparing the carboxylic dispersant compositions useful in this invention:

EXAMPLE (B-2)-1

A polyisobutenyl succinic anhydride is prepared by the reaction of a chlorinated polyisobutylene with maleic anhydride at 200° C. The polyisobutenyl group has an average molecular weight of 850 and the resulting alkenyl succinic anhydride is found to have an acid number of 113 (corresponding to an equivalent weight of 500). To a mixture of 500 grams (1 equivalent) of this polyisobutenyl succinic anhydride and 160 grams of toluene there is added at room temperature 35 grams (1 equivalent) of diethylene triamine. The addition is made portionwise throughout a period of 15 minutes, and an initial exothermic reaction caused the temperature to rise to 50° C. The mixture then is heated and a water-toluene azeotrope distilled from the mixture. When no more water distills, the mixture is heated to 150° C. at reduced pressure to remove the toluene. The residue is diluted with 350 grams of mineral oil and this solution is found to have a nitrogen content of 1.6%.

EXAMPLE (B-2)-2

The procedure of Example (B-2)-1 is repeated using 31 grams (1 equivalent) of ethylene diamine as the amine reactant. The nitrogen content of the resulting product is 1.4%.

EXAMPLE (B-2)-3

The procedure of Example (B-2)-1 is repeated using 55.5 grams (1.5 equivalents) of an ethylene amine mixture having a composition corresponding to that of triethylene tetramine. The resulting product has a nitrogen content of 1.9%.

EXAMPLE (B-2)-4

The procedure of Example (B-2)-1 is repeated using 55.0 grams (1.5 equivalents) of triethylene tetramine as the amine reactant. The resulting product has a nitrogen content of 2.9%.

EXAMPLE (B-2)-5

An acylated nitrogen composition is prepared according to the procedure of Example (B-2)-1 except that the reaction mixture consists of 3800 grams of the polyisobutenyl succinic anhydride, 376 grams of a mixture of triethylene tetramine and diethylene triamine (75:25) weight ratio), and 2785 grams of mineral oil. The product is found to have a nitrogen content of 2%.

EXAMPLE (B-2)-6

A mixture of 510 parts (0.28 mole) of polyisobutene (Mn=1845; Mw=5325) and 59 parts (0.59 mole) of maleic anhydride is heated to 110° C. This mixture is heated to 190° C. in 7 hours during which 43 parts (0.6 mole) of gaseous chlorine is added beneath the surface. At 190°-192° C. an additional 11 parts (0.16 mole) of chlorine is added over 3.5 hours. The reaction mixture is stripped by heating at 190°-193° C. with nitrogen blowing for 10 hours. The residue is the desired polyisobutene-substituted succinic acylating agent having a saponification equivalent number of 87 as determined ASTM procedure D-94.

A mixture is prepared by the addition of 10.2 parts (0.25 equivalent) of a commercial mixture of ethylene polyamines having from about 3 to about 10 nitrogen atoms per molecule to 113 parts of mineral oil and 161 parts (0.25 equivalent) of the substituted succinic acylating agent at 130° C. The reaction mixture is heated to 150° C. in 2 hours and stripped by blowing with nitrogen. The reaction mixture is filtered to yield the filtrate as an oil solution of the desired product.

EXAMPLE (B-2)-7

A mixture of 100 parts (0.495 mole) of polyisobutene (Mn=2020; Mw=6049) and 115 parts (1.17 moles) of maleic anhydride is heated to 100° C. This mixture is heated to 84° C. in 6 hours during which 85 parts (1.2 moles) of gaseous chlorine is added beneath the surface. At 184°-89° C., an additional 59 parts (0.83 mole) of chlorine is added over 4 hours. The reaction mixture is stripped by heating at 186°-190° C. with nitrogen blowing for 26 hours. The residue is the desired polyisobutene-substituted succinic acylating agent having a saponification equivalent number of 87 as determined by ASTM procedure D-94.

A mixture is prepared by the addition of 57 parts (1.38 equivalents) of a commercial mixture of ethylene polyamine having from about 3 to 10 nitrogen atoms per molecule to 1067 parts of mineral oil and 893 parts (1.38 equivalents) of the substituted succinic acylating agent at 140°-145° C. The reaction mixture is heated to 155° C. in 3 hours and stripped by blowing with nitrogen. The reaction mixture if filtered to yield the filtrate as an oil solution of the desired product.

EXAMPLE (B-2)-8

A four-necked, 500 ml. flask is charged with 201 grams tetraethylenepentamine (TEPA), 151 grams of 40% aqueous Tris(hydroxymethyl)-aminomethane (THAM) and 3.5 grams of 85% $H_3PO_4$ as catalyst. The mixture is heated to 120° C. over 1 hour. With $N_2$ sweeping, the mixture is heated to 130° C. over 1 hour and to 230° C. over 2 hours more. The mixture is held at 230°-240° C. for 4 hours and at 241°-250° C. for 3 hours. The contents are cooled to 150° C. and filtered. In a 12-liter flask are added 460 grams of the filtered contents and 2500 grams diluent oil. The mixture is heated to 105° C. and 3360 grams of a poly(isobutene)(molecular weight 1000)-substituted succinic anhydride having a saponification number of 100 was added over 1.5 hours while slowly blowing with nitrogen. The mixture is heated to 160° C. and held for 5 hours. The mixture is filtered at 150° C. to give a product containing 2.31% nitrogen and no free amine.

(B-3) Diaryl amine

The diaryl amines having utility in this invention are N,N-diphenylamine; N-phenyl-N-naphthylamine and N,N-dinaphthylamine as well as any alkyl substituted derivative of the aryl group wherein the alkyl substituent contains from 1 to about 24 carbon atoms. The preferred diaryl amine is nonylated-diphenylamine of the formula

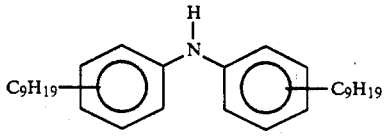

B-4 The Sulfurized Composition

Within the purview of this invention, two different sulfurized compositions are envisaged and have utility. The first sulfurized composition, (B-4a) is a sulferized olefin prepared by reacting an olefin/sulfur halide complex by contacting the complex with a protic solvent in the presence of metal ions at a temperature in the range of 40° C. to 120° C. and thereby removing halogens from the sulfurized complex and providing a dehalogenated sulfurized olefin; and isolating the sulfurized olefin.

The preparation of (B-4a) generally involves reacting an olefin with a sulfur halide to obtain an alkyl/sulfur halide complex, a sulfochlorination reaction. This complex is contacted with metal ions and a protic solvent. The metal ions are in the form of $Na_2S$/NaSH which is obtained as an effluent of process streams from hydrocarbons, additional $Na_2S$ and NaOH. The $Na_2S$/NaSH may also be in the form of a fresh solution, that is, not recycled. The protic solvent is water and an alcohol of 4 carbon atoms or less. Preferably, the alcohol is isopropyl alcohol. The reaction with the metal ions and protic solvent represents a sulfurization-dechlorination reaction. The metal ions are present in an aqueous solution. The metal ions solution is prepared by blending an aqueous $Na_2S$. solution with the $Na_2S$/NaSH process streams. Water and aqueous NaOH are added as necessary to adjust the $Na_2S$ and NaOH concentration to a range of 18-21% $Na_2S$ and 2-5% NaOH. A sulfurized product is obtained which is substantially free of any halide, i.e. the product obtained has had enough of the halide removed so that it is useful as a lubricant additive.

A wide variety of olefinic substances may be charged to the initial sulfochlorination reaction including hydrocarbon olefins having a single double bond with terminal or internal double bonds and containing from about 2 to 50 or more, preferably 2 to 8 carbon atoms per molecule in either straight, branched chain or cyclic compounds, and these may be exemplified by ethylene, propylene, butene-1, cis and trans butene-2, isobutylene, diisobutylene, triisobutylene, pentenes, cyclopentene, cyclohexene, the octenes, decene-1, etc. In general, C3-6 olefins or mixtures thereof are desirable for preparing sulfurized products for use as extreme pressure additives as the combined sulfur content of the product decreases with increasing carbon content yet its miscibility with oil is lower for propylene and ethylene derivatives.

Isobutylene is particularly preferred as the sole olefinic reactant, but it may be employed, desirably in major proportion, in mixtures containing one or more other olefins; moreover, the charge may contain substantial proportions of saturated aliphatic hydrocarbons as exemplified by methane, ethane, propane, butanes, pentanes, etc. Such alkanes are preferably present in minor proportion in most instances to avoid unnecessary dilution of the reaction, since they neither react nor remain in the products but are expelled in the off-gases or by subsequent distillation. However, mixed charges can substantially improve the economics of the present process since such streams are of lower value than a stream of relatively pure isobutylene.

The other reactant in the preparation of (B-4a) is the sulfurizing agent. This agent may be selected from compounds such as sulfur monochloride ($S_2Cl_2$); sulfur dichloride; and $S_3Cl_2$ as well as the corresponding but more expensive sulfur bromides. The sulfurizing agent may be employed in an amount which will provide the desired quantity of sulfur. The amount of sulfurization desired will vary depending on the end use of the product and can be determined by one of ordinary skill in the art. The molar ratio of olefin to sulfur halide will vary depending on the amount of sulfurization desired in the end product and the amount of olefinic unsaturation. The molar ratio of sulfur halide to olefin could vary from 1:(1-20). When the olefin to be sulfurized contains a single double bond, one mole of the olefin can be reacted with 0.5 moles or less of $S_2Cl_2$ (sulfur monochloride). The olefin is generally added in excess with respect to the amount of the sulfur being added so that all of the sulfur halide will be reacted and any unreacted olefin can remain as unreacted diluent oil or can be removed and recycled.

An olefin or mixture of olefins and a sulfur halide or mixture of sulfur halides are sufficiently reacted to form an olefin/sulfur halide complex.

After the sulfurization-dechlorination reaction, the reaction mixture is allowed to stand and separate into an aqueous layer and another liquid layer containing the desired organic sulfide product. The product is usually dried by heating at moderately elevated temperatures under subatmospheric pressure, and its clarity may often be improved by filtering the dried product through a bed of bauxite, clay or diatomaceous earth particles.

The following example is provided so as to provide those of ordinary skill in the art with a complete disclosure and description of how to make the (B-4a).

EXAMPLE (B-4a)-1

Added to a three-liter, four-necked flask are 1100 grams (8.15 moles) of sulfur monochloride. While stirring at room temperature 952 grams (17 moles) of isobutylene are added below the surface. The reaction is exothermic and the addition rate of isobutylene controls the reaction temperature. The temperature is allowed to reach a maximum of 50° C. and obtained is a sulfochlorination reaction product.

A blend of 1800 grams of 18% $Na_2S$ solution is obtained from process streams. To this blend is added 238 grams 50% aqueous NaOH, 525 grams water and 415 grams isopropyl alcohol to prepare a reagent for use in the sulfurization-dechlorination reaction. To this reagent is added 1000 grams of the sulfo-chlorination reaction product in about 1.5 hours. One hour after the addition is completed, the contents are permitted to settle and the liquid layer is drawn off and discarded. The organic layer is stripped to 120° C. and 100 mm Hg to remove any volatiles. Analyses: % sulfur 43.5, % chlorine 0.2.

Table I outlines other olefins and sulfur chlorides that can be utilized in preparing (B-4a). The procedure is essentially the same .as in Example (B-4a)-1. In all the examples, the metal ion reagent is prepared according to Example (B-4a)-1.

TABLE I

| Example | Olefin | Sulfur Chloride | Mole Ratio of Olefin:SCl |
|---|---|---|---|
| (B-4a)-2 | n-butene | $SCl_2$ | 2.3:1 |
| (B-4a)-3 | propene | $S_2Cl_2$ | 2.5:1 |
| (B-4a)-4 | n-pentene | $S_2Cl_2$ | 2.2:1 |
| (B-4a)-5 | n-butene/isobutylene 1:1 weight | $S_2Cl_2$ | 2.5:1 |
| (B-4a)-6 | isobutylene/2-pentene 1:1 weight | $S_2Cl_2$ | 2.2:1 |
| (B-4a)-7 | isobutylene/2-pentene 3:2 weight | $S_2Cl_2$ | 2.2:1 |
| (B-4a)-8 | isobutylene/propene 6:1 weight | $S_2Cl_2$ | 2.3:1 |
| (B-4a)-9 | n-pentene/2-pentene 1:1 weight | $S_2Cl_2$ | 2.2:1 |
| (B-4a)-10 | 2-pentene/propene 3:2 weight | $S_2Cl_2$ | 2.2:1 |

The second sulfurized composition (B-4-b) is an oil-soluble sulfur-containing material which comprises the reaction product of sulfur and a Diels-Alder adduct. The Diels-Alder adducts are a well-known, art-recognized class of compounds prepared by the diene synthesis or Diels=Alder reaction. A summary of the prior art relating to this class of compounds is found in the Russian monograph, *Dienovyi Sintes*, Izdatelstwo Akademii Nauk SSSR, 1963 by A.S. Onischenko. (Translated into the English language by L. Mandel as A.S. Onischenko, *Diene Synthesis*, N.Y., Daniel Davey and Co., Inc., 1964). This monograph and references cited therein are incorporated by reference into the present specification.

Basically, the diene synthesis (Diels-Alder reaction) involves the reaction of at least one conjugated diene, >C=C—C<, with at least one ethylenically or acetylenically unsaturated compound, >C=C<, these latter compounds being known as dienophiles. The reaction can be represented as follows:

Reaction 1:

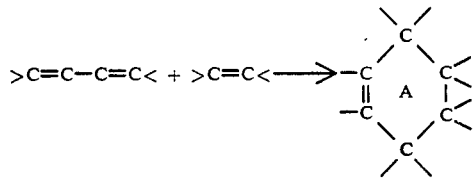

Reaction 2:

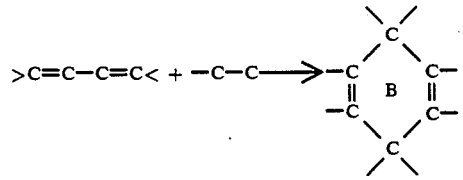

The products, A and B are commonly referred to as Diels-Alder adducts. It is these adducts which are used as starting materials for the preparation of (B-4a).

Representative examples of such 1,3-dienes include aliphatic conjugated diolefins or dienes of the formula

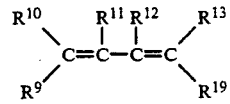

(X)

wherein $R^9$ through $R^{14}$ are each independently selected from the group consisting of halogen, alkyl, halo, alkoxy, alkenyl, alkenyloxy, carboxy, cyano, amino, alkylamino, dialkylamino, phenyl, and phenyl-substituted with 1 to 3 substituents corresponding to $R^9$ through $R^{14}$ with the proviso that a pair of R's on adjacent carbons do not form an additional double bond in the diene. Preferably not more than three of the R variables are other than hydrogen and at least one is hydrogen. Normally the total carbon content of the diene will not exceed 20. In one preferred aspect of the invention, adducts are used where $R^{11}$ and $R^{12}$ are both hydrogen and at least one of the remaining R variables is also hydrogen. Preferably, the carbon content of these R variables when other than hydrogen is 7 or less. In this most preferred class, those dienes where $R^9$, $R^{10}$, $R^{13}$, and $R^{14}$ are hydrogen, chloro, or lower alkyl are especially useful. Specific examples of the R variables include the following groups: methyl, ethyl, phenyl, HOOC—, N=C—, $CH_3O$—, $CH_3COO$—, $CH_3CH_2O$—, $CH_3C(O)$—, HC(O)—, Cl, Br, tert-butyl, $CF_3$, tolyl, etc. Piperylene, isoprene, methylisoprene, chloroprene, and 1,3-butadiene are among the preferred dienes for use in preparing the Diels-Alder adducts.

In addition to these linear 1,3-conjugated dienes, cyclic dienes are also useful as reactants in the formation of the Diels-Alder adducts. Examples of these cyclic dienes are the cyclopentadienes, fulvenes, 1,3-cyclohexadienes, 1,3-cycloheptadienes, 1,3,5-cycloheptatrienes, cyclooctatetraene, and 1,3,5-cyclonoatrienes. Various substituted derivatives of these compounds enter into the diene synthesis.

The dienophiles suitable for reacting with the above dienes to form the adducts used as reactants can be represented by the formula

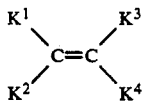

(XI)

wherein the K variables are the same as the R variables in Formula above with the proviso that a pair of K's may from an additional carbon-to-carbon bond, i.e., $K^1—C{=}C—K^3$, but do not necessarily do so.

A preferred class of dienophiles are those wherein at least one of the K variables is selected from the class of electron-accepting groups such as formyl, cyano, nitro, carboxy, carbohydrocarbyloxy, hydrocarbylcarbonyl, hydrocarbylsulfonyl, carbamyl, acylcarbanyl, N-acyl-N-hydrocarbylcarbamyl, N-hydrocarbylcarbamyl, and N, N-dihydrocarbylcarbamyl. Those K variables which are not electron-accepting groups are hydrogen, hydrocarbyl, or substituted-hydrocarbyl groups. Usually the hydrocarbyl ad substituted hydrocarbyl groups will not contain more than 10 atoms each.

The hydrocarbyl groups present as N-hydrocarbyl substituents are preferably alkyl of 1 to 30 carbons and especially 1 to 10 carbons. Representative of this class of dienophiles are the following: nitroalkenes, e.g., 1-nitrobutene-1, 1-nitropentene-1, 3-methyl-1-nitrobutene-1, 1-nitroheptene-1, 1-nitrooctene-1, 4-ethoxy-1-nitrobutene-1; alpha, beta-ethylenically unsaturated aliphatic carboxylic acid esters, e.g., alkylacrylates and alpha-methyl alkylacrylates (i.e., alkyl methacrylates) such as butylacrylate and butylmethacrylate, decyl acrylate and decylmethacrylate, di-(n-butyl)-maleate, di-(t-butyl-maleate); acrylonitrile, methacrylonitrile, beta-nitrostyrene, methylvinyl-sulfone, acrolein, acrylic acid; alpha, beta-ethylenically unsaturated aliphatic carboxylic acid amides, e.g., acrylamide, N, N-dibutylacrylamide, methacrylamide, N-dodecylmethacrylamide, N-pentylcrotonamide; crotonaldehyde, crotonic acid, beta, beta-dimethyldivinylketone, methyl-vinylketone, N-vinyl pyrrolidone, alkenyl halides, and the like.

One preferred class of dienophiles are those wherein at least one, but not more than two of K variables is—C(O)O—$R^o$ where $R^o$ is the residue of a saturated aliphatic alcohol of up to about 40 carbon atoms; e.g., for example at least one K is carbohydrocarbyloxy such as carboethoxy, carbobutoxy, etc., the aliphatic alcohol from which —$R^o$ is derived can be a mono or polyhydric alcohol such as alkyleneglycols, alkanols, aminoalkanols, alkoxy-substituted alkanols, ethanol, ethoxy ethanol, propanol, beta-diethylaminoethanol, dodecyl alcohol, diethylene glycol, tripropylene glycol, tetrabutylene glycol, hexanol, octanol, isooctyl alcohol, and the like. In this especially preferred class of dienophiles, not more than two K variables will be —C(O)—O—$R^o$ groups and the remaining K variables will be hydrogen or lower alkyl, e.g., methyl, ethyl, propyl, isopropyl, and the like.

Specific examples of dienophiles of the type discussed above are those wherein at least one of the K variables is one of the following groups: hydrogen, methyl, ethyl, phenyl, HOOC—, HC(O)—, $CH_2{=}CH$—, HC=C, $CH_3C(O)$)—, $ClCH_2$—, $HOCH_2$—, alpha-pyridyl, —$NO_2$, Cl, Br, propyl, iso-butyl, etc.

In addition to the ethylenically unsaturated dienophiles, there are many useful acetylenically unsaturated dienophiles such as propiolaldehyde, methylethynylketone, propylethynylketone, propenylethynylketone, propiolic acid, propiolic acid nitrile, ethylopropiolate, tetrolic acid, propargylaldehyde, acetylenedicarboxylic acid, the dimethyl ester of acetylenedicarboxylic acid, dibenzoylacetylene, and the like.

Cyclic dienophiles include cyclopentenedione, coumarin, 3-cyanocourmarin, dimethyl maleic anhydride, 3, 6-endomethylene-cyclohexenedicarboxylic acid, etc. With the exception of the unsaturated dicarboxylic anhydrides derived from linear dicarboxylic acids (e.g., maleic anhydride, methylmaleic anhydride, chloromaleic anhydride), this class of cyclic dienophiles are limited in commercial usefulness due to their limited availability and other economic considerations.

The reaction products of these dienes and dienophiles correspond to the general formulae

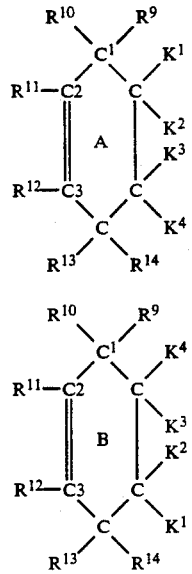

(XIII)

wherein $R^9$ through $R^{14}$ and $K^1$ through $K^4$ are as defined hereinbefore. If the dienophile moiety entering into the reaction is acetylenic rather than ethylenic, two of the K variables, one from each carbon, form another carbon-to-carbon double bond. Where the diene and/or the dienophile is itself cyclic, the adduct obviously will be bicyclic, tricyclic, fused, etc., as exemplified below:

Reaction 3:

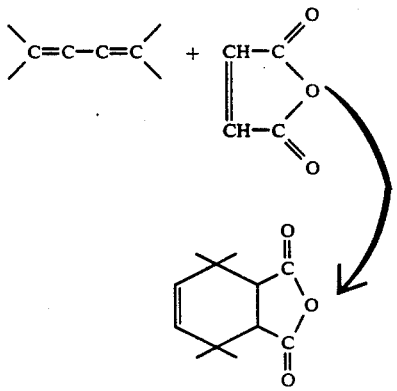

Reaction 4:

-continued

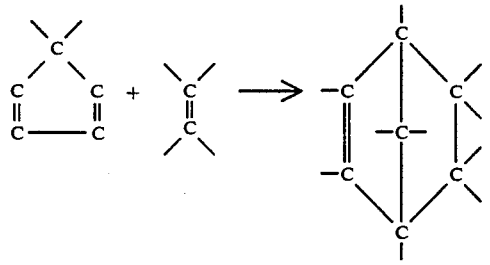

Normally, the adducts involve the reaction of equimolar amounts of diene and dienophile. However, if the dienophile has more than one ethylenic linkage, it is possible for additional diene to react if present in the reaction mixture.

The adducts and processes of preparing the adducts are further exemplified by the following examples. Unless otherwise indicated in these examples and in other parts of this specification, as well as in the appended claims, all parts and percentages are by weight.

EXAMPLE A

A mixture comprising 400 parts of toluene and 66.7 parts of aluminum chloride is charged to a two-liter flask fitted with a stirrer, nitrogen inlet tube, and a solid carbon dioxide-cooled reflux condenser. A second mixture comprising 640 parts (5 moles) of butyl acrylate and 240.8 parts of toluene is added to the AlC13 slurry while maintaining the temperature within the range of 37°-58° C. over a 0.25-hour period. Thereafter, 313 parts (5.8 moles) of butadiene is added to the slurry over a 2.75-hour period while maintaining the temperature of the reaction mass at 50°-61° C. by means of external cooling. The reaction mass is blown with nitrogen for about 0.33 hour and then transferred to a four-liter separatory funnel and washed with a solution of 150 parts of concentrated hydrochloric acid in 1100 parts of water. Thereafter, the product is subjected to two additional water washings using 1000 parts of water for each wash. The washed reaction product is subsequently distilled to remove unreacted butyl acrylate and toluene. The residue of this first distillation step is subjected to further distillation at a pressure of 9-10 millimeters of mercury whereupon 785 parts of the desired product is collected over the temperature of 105°-115° C.

EXAMPLE B

The adduct of isoprene and acrylonitrile is prepared by mixing 136 parts of isoprene, 106 parts of acrylonitrile, and 0.5 parts of hydroquinone (polymerization inhibitor) in a rocking autoclave and thereafter heating for 16 hours at a temperature within the range of 130°-140 C. The autoclave is vented and the contents decanted thereby producing 240 parts of a light yellow liquid. This liquid is stripped at a temperature of 90° C. and a pressure of 10 millimeters of mercury thereby yielding the desired liquid product as the residue.

EXAMPLE C

Using the procedure of Example B, 136 parts of isoprene, 172 parts of methyl acrylate, and 0.9 part of hydroquinone are converted to the isoprenemethyl acrylate adduct.

EXAMPLE D

Following the procedure of Example B, 104 parts of liquified butadiene, 166 parts of methyl acrylate, and 1 part of hydroquinone are charged to the rocking autoclave and heated to 130°-135° for 14 hours. The product is subsequently decanted and stripped yielding 237 parts of the adduct.

EXAMPLE E

The adduct of isoprene and methyl methacrylate is prepared by reacting 745 parts of isoprene with 1095 parts of methyl methacrylate in the presence of 5.4 parts of hydroquinone in the rocking autoclave following the procedure of Example B above. 1490 parts of the adduct is recovered.

EXAMPLE F

The adduct of butadiene and dibutyl maleate (810 parts) is prepared by reacting 915 parts of dibutyl maleate, 216 parts of liquified butadiene, and 3.4 parts of hydroquinone in the rocking autoclave according to the technique of Example B.

EXAMPLE G

A reaction mixture comprising 378 parts of butadiene, 778 parts of N-vinylpyrrolidone, and 3.5 parts of hydroquinone is added to a rocking autoclave previously chilled to −35° C. The autoclave is then heated to a temperature of 130°-140° C. for about 15 hours. After venting, decanting, and stripping the reaction mass, 75 parts of the desired adduct are obtained.

EXAMPLE H

Following the technique of Example B, 270 parts of liquified butadiene, 1060 parts of isodecyl acrylate, and 4 parts of hydroquinone are reacted in the rocking autoclave at a temperature of 130°-140° C. for about 11 hours. After decanting the stripping, 1136 parts of the adduct are recovered.

EXAMPLE I

Following the same general procedure of Example A, 132 parts (2 moles) of cyclopentadiene, 256 parts (2 moles) of butyl acrylate, and 12.8 parts of aluminum chloride are reacted to produce the desired adduct. The butyl acrylate and the aluminum chloride are first added to a two-liter flask fitted with stirrer and reflux condenser. While heating reaction mass to a temperature within the range of 59°-52° C., the cyclopentadiene is added to the flask over a 0.5-hour period. Thereafter the reaction mass is heated for about 7.5 hours at a temperature of 95°-100° C. The product is washed with a solution containing 400 parts of water and 100 parts of concentrated hydrochloric acid and the aqueous layer is discarded. Thereafter, 1500 parts of benzene are added to the reaction mass and the benzene solution is washed with 300 parts of water and the aqueous phase removed. The benzene is removed by distillation and the residue stripped at 0.2 parts of mercury to recover the adduct as a distillate.

EXAMPLE J

Following the technique of Example B, the adduct of butadiene and ally chloride is prepared using two moles of each reactant.

EXAMPLE K

One-hundred thirty-nine parts (1 mole) of the adduct of butadiene and methyl acrylate is transesterified with 158 parts (1 mole) of decyl alcohol. The reactants are added to a reaction flask and 3 parts of sodium methoxide are added. Thereafter, the reaction mixture is heated at a temperature of 190°-200° C. for a period of 7 hours. The reaction mass is washed with a 10% sodium hydroxide solution and then 250 parts of naphtha is added. The naphtha solution is washed with water. At the completion of the washing, 150 parts of toluene are added and the reaction mass is stripped at 150° C. under pressure of 28 parts of mercury. A dark-brown fluid product (225 parts) is recovered. This product is fractionated under reduced pressure resulting in the recovery of 178 parts of the product boiling in the range of 130°-133° C. at a pressure of 0.45 to 0.6 parts of mercury.

EXAMPLE L

The general procedure of Example A is repeated except that only 270 parts (5 moles) of butadiene is included in the reaction mixture.

The sulfurized compositions (B-4b) are readily prepared by heating a mixture of sulfur and at least one of the Diels-Alder adducts of the types discussed hereinabove at a temperature within the range of from about 100° C. to just below the decomposition temperature of the Diels-Alder adducts. Temperatures within the range of about 100° to about 200° C. will normally be used. This reaction results in a mixture of products, some of which have been identified. In the compounds of know structure, the sulfur reacts with the substituted unsaturated cycloaliphatic reactants at a double bond in the nucleus of the unsaturated reactant.

The molar ratio of sulfur to Diels-Alder adduct used in the preparation of the sulfur-containing composition is from about 1:2 up to about 4:1. Generally, the molar ratio of sulfur to Diels-Alder adduct will be from about 1:1 to about 4:1 and preferably about 2:1 to about 4:1 based on the presence of one ethylenically unsaturated bond in the cycloaliphatic nucleus. If there additional unsaturated bonds in the cycloaliphatic nucleus, the ratio of sulfur may be increased.

The reaction can be conducted in the presence of suitable inert organic solvents such as mineral oils, alkanes of 7 to 18 carbons, etc., although no solvent is generally necessary. After completion of the reaction, the reaction mass can be filtered and/or subjected to other conventional purification techniques. There is no need to separate the various sulfur-containing products as they can be employed in the form of a reaction mixture comprising the compounds of known and unknown structure.

As hydrogen sulfide is an undesirable contaminant, it is advantageous to employ standard procedures for assisting in the removal of the H2S from the products. Blowing with steam, alcohols, air, or nitrogen gas assists in the removal of H2S as does heating at reduced pressures with or without the blowing.

When the Diels-Alder adduct is of the type represented by Formula XIII (A) or (B), the sulfur-containing products of known structure correspond to the following generic formulae:

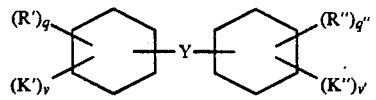

(XIV)

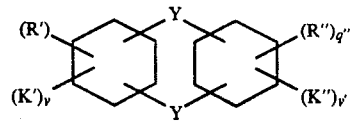

(XV)

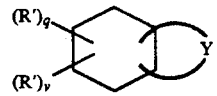

(XVI)

wherein R' and R'' are the same as $R^9$ through $R^{14}$ above and K' and K'' are the same as $K^1$ through $K^4$ above. Y is a divalent sulfur group. The variables q and q'' are zero or a positive whole number of 1 to 6 while v and v' are zero or positive whole number of 1 to 4, at least one of R', R'', K', and K'' in each compound being other than hydrogen or a saturated aliphatic hydrocarbon group. Generally not more than five of the R and K variables on each ring are other than hydrogen. Preferably, at least one K variable in each compound will be an electron accepting group of the type discussed supra. The preferred class of substituents discussed hereinbefore with regard to the various "K" and "R" variables on the intermediates for making the Diels-Alder adducts and the adducts themselves obviously applies to the final products prepared from the intermediates.

An especially preferred class of (B-4b) within the ambit of Formulae XIV-XVI is the therein at least one of the K variables is an electron accepting group from the class consisting of $$-\overset{\overset{W''}{\|}}{C}-R^{15},\quad -\overset{\overset{O}{\|}}{\underset{\underset{O}{\|}}{S}}-R^{15},\quad -C\equiv N,\quad \text{and}\quad -NO_2$$

wherein W'' is oxygen or divalent sulfur, and $R^{15}$ is hydrogen, halo, alkyl of 1 to 30 carbons, alkenyl of 1 to 30 carbons, hydroxy, alkoxy, of 1 to 30 carbons, alkenoxy of 1 to 30 carbons, amino, alkylamino and dialkylamine wherein the alkyl groups contain from 1 to 30 carbons and preferably 1 to 10 carbons. Preferably, W'' is oxygen. When $R^{15}$ is halo, chloro is preferred. Particularly useful are those compounds wherein the R's are hydrogen or lower alkyl and one K variable is carboalkoxy of up to 31 carbon atoms, the remaining K groups being hydrogen, lower alkyl, or another electron accepting group. Within this latter group, those wherein the carboalkoxy group is carbo-n-butoxy produce excellent results as lubricant additives.

It is sometimes advantageous to incorporate materials useful as sulfurization catalysts in the reaction mixture. These materials may be acidic, basic or neutral, Useful neutral and acidic materials, include acidified clays such as "Super Filtrol", p-toluenesulfonic acid, dialkylphosphorodithioic acids, phosphorus sulfides such as phosphorus pentasulfide and phosphites such as triaryl phosphites (e.g., triphenyl phosphite).

The basic materials may be inorganic oxides and salts such as sodium hydroxide, calcium oxide and sodium sulfide. The most desirable basic catalysts, however, are nitrogen bases including ammonia and amines. The amines include primary, secondary and tertiary hydrocarbyl amines wherein the hydrocarbyl radicals are alkyl, aryl, aralkyl, alkaryl or the like and contain about 1-20 carbon atoms. Suitable amines include aniline, benzylamine, dibenzylamine, dodecylamine, naphthylamine, tallow amines, N-ethyldipropylamine, N-phenylbenzylamine, N,N-diethylbutylamine, m-toluidine and 2,3-xylidine. Also useful are heterocyclic amines such as pyrrolidine, N-methylpyrrolidine, piperidine, pyridine and quinoline.

The preferred basic catalysts include ammonia and primary, secondary, or tertiary alkylamines having about 1-8 carbon atoms in the alkyl radicals. Representative amines of this type are methylamine, dimethylamine, trimethylamine, ethylamine, diethylamine, triethylamine, di-n-butylamine, tri-n-butylamine, tri-sec-hexylamine and tri-n-octylamine. Mixtures of these amines can be used, as well as mixtures of ammonia and amines.

When a catalyst is used, the amount is generally about 0.05-2.0% of the weight of the adduct.

The following examples illustrate the preparation of (B-4b).

EXAMPLE (B-4b)-1

To 255 parts (1.65 moles) of the isoprene methacrylate adduct of Example C heated to a temperature of 110°-120° C., there are added 53 parts (1.65 moles) of sulfur flowers over a 45-minute period. The heating is continued for 4.5 hours at a temperature in the range of 130°-160° C. After cooling to room temperature, the reaction mixture is filtered through a medium sintered glass funnel. The filtrate consists of 301 parts of the desired (B-4b).

EXAMPLE (B-4b)-2

A reaction mixture comprising 1175 parts (6 moles) of the Diels-Alder adduct of butyl acrylate and isoprene and 192 parts (6 moles) of sulfur flowers is heated for 0.5 hour at 108°-110° C. and then to 155°-165° C. for 6 hours while bubbling nitrogen gas through the reaction mixture at 0.25 to 0.5 standard cubic feet per hour. At the end of the heating period, the reaction mixture is allowed to cool and filtered at room temperature. Thereafter, the product is permitted to stand for 24 hours and refiltered. The filtrate is the desired (B-4b).

EXAMPLE (B-4b)-3

Sulfur (4.5 moles) and the adduct of isoprene-methyl methacrylate (4.5 moles are mixed at room temperature and heated for one hour at 100° C. while blowing nitrogen through the reaction mass at 0.25-0.5 standard cubic feet per hour. Subsequently the reaction mixture is raised to a temperature of 150°-155° C. for 6 hours while maintaining the nitrogen blowing. After heating, the reaction mass is permitted to stand for several hours while cooling to room temperature and is thereafter filtered. The filtrate consists of 842 parts of the desired (B-4b).

EXAMPLE (B-4b)-4

A one-liter flask fitted with a stirrer, reflux, condenser, and nitrogen inlet line is charged with 256 parts (1 mole) of the adduct of butadiene and isodecyl acrylate, and 51 grams (1.6 moles) of sulfur flowers and then heated for 12 hours at a temperature, stand for 21 hours, and filtered at room temperature to produce the desired (B-4b) as the filtrate.

EXAMPLE (B-4b)-5

A mixture of 1703 parts (9.4 moles) of a butyl acrylate-butadiene adduct prepared as in Example L, 280 parts (8.8 moles) of sulfur and 17 parts of triphenyl phosphite is prepared in a reaction vessel and heated gradually over 2 hours to a temperature of about 185° C. while stirring and sweeping with nitrogen. The reaction is exothermic near 160°-170° C., and the mixture is maintained at about 185° C. for 3 hours. The mixture is c to 90° C. over a period of 2 hours and filtered using a filter aid. The filtrate is the desired (B-4b) containing 14.0% sulfur.

EXAMPLE (B-4b)-6

The procedure of Example (B-4b)-5 is repeated except that the triphenyl phosphite is omitted from the reaction mixture.

EXAMPLE (B-4b)-7

The procedure of Example (B-4b)-5 is repeated except that the triphenyl phosphite is replaced by 2.0 parts of triamyl amine as sulfurization catalyst.

EXAMPLE (B-4b)-8

A mixture of 547 parts of a butyl acrylatebutadiene adduct prepared as in Example L and 5.5 parts of triphenyl phosphite is prepared in a reaction vessel and heated with stirring to a temperature of about 50° C. whereupon 94 parts of sulfur are added over a period of 30 minutes. The mixture is heated to 150° C. in 3 hours while sweeping with nitrogen. The mixture then is heated to about 185° C. in approximately one hour. The reaction is exothermic and the temperature is maintained at about 185° C. by using a cold water jacket for a period of about 5 hours. At this time, the contents of the reaction vessel are cooled to 85° C. and 33 parts of mineral oil are added. The mixture is filtered at this temperature, and the filtrate is the desired (B-4b) wherein the sulfur to adduct ratio is 0.98/1.

EXAMPLE (B-4b)-9

The general procedure of Example (B-4b)-8 with the exception that the triphenyl phosphite is not included in the reaction mixture.

EXAMPLE (B-4b)-10

A mixture of 500 parts (2.7 moles) of a butyl acrylate-butadiene adduct prepared as in Example L and 109 parts (3.43 moles) of sulfur is prepared and heated to 180° C. and maintained at a temperature of about 180°-190° C. for about 6.5 hours. The mixture is cooled while sweeping with a nitrogen gas to remove hydrogen sulfide odor. The reaction mixture is filtered and the filtrate is the desired (B-4b) containing 15.8% sulfur.

EXAMPLE (B-4b)-11

A mixture of 728 parts (4.0 moles) of a butyl acrylate-butadiene adduct prepared as in Example L, 218 parts (6.8 moles) of sulfur, and 7 parts of triphenyl phosphite is prepared and heated with stirring to a temperature of about 181° C. over a period of 1.3 hours. The mixture is maintained under a nitrogen purge at a temperature of 181°-187° C. for 3 hours. After allowing the material to cool to about 85° C. over a period of 1.4 hours, the mixture is filtered using a filter aid, and the filtrate is the desired (B-4b) containing 23.1% sulfur.

EXAMPLE (B-4b)-12

A mixture of 910 parts (5 moles) of a butyl acrylate-butadiene adduct prepared as in Example L, 208 parts (6.5 moles) of sulfur and 9 parts of triphenyl phosphite is prepared and heated with stirring and nitrogen sweeping to a temperature of about 140° C. over 1.3 hours. The heating is continued to raise the temperature to 187° C. over 1.5 hours, and the material is held at 183°-187° C. for 3.2 hours. After cooling the the mixture is filtered with a filter aid, and the filtrate is the desired (B-4b) containing 18.2% sulfur.

EXAMPLE (B-4b)-13

A mixture of 910 parts (5 moles) of a butyl acrylate-butadiene adduct prepared as in Example L, 128 parts (4 moles) of sulfur and 9 parts of triphenyl phosphite is prepared and heated with stirring while sweeping with nitrogen to a temperature of 142° C. over a period of about one hour. The heating is continued to raise the temperature to 185°-186° C. over about 2 hours and the mixture is maintained at 185°-187° C. for 3.2 hours. After allowing the reaction mixture to cool to 96° C., the mixture is filtered with filter aid, and the filtrate is the desired (B-4b) containing 12.0% sulfur.

EXAMPLE (B-4b)-14

The general procedure of Example (B-4b)-13 is repeated except that the mixture contain 259 parts (8.09 moles) of sulfur. The (B-4b) obtained in this manner contains 21.7% sulfur.

It has been found that, if the (B-4b) is treated with an aqueous solution of sodium sulfide containing from 5% to about 75% by weight $Na_2S$, the treated product may exhibit less of a tendency to darken freshly polished copper metal.

Treatment involves the mixing together (B-4b) and the sodium sulfide solution for a period of time sufficient for any unreacted sulfur to be scavenged, usually a period of a few minutes to several hours depending on the amount of unreacted sulfur, the quantity and the concentration of the sodium sulfide solution. The temperature is not critical but normally will be in the range of about 20° C. to about 100° C. After the treatment, the resulting aqueous phase is separated from the organic phase by conventional techniques, i.e., decantation, etc. Other alkali metal sulfides, M2Sx where M is an alkali metal and x is 1, 2, or 3 may be used to scavenge unreacted sulfur but those where x is greater than 1 are not nearly as effective. Sodium sulfide solutions are preferred for reasons of economy and effectiveness. This procedure is described in more detail in U.S. Pat. No. 3,498,915.

It has also been determined that treatment of (B-4b) with solid, insoluble acidic materials such as acidified clays or acidic resins and thereafter filtering the sulfurized reaction mass improves the product with respect to its color and solubility characteristics. Such treatment comprises thoroughly mixing the reaction mixture with from about 0.1% to about 10% by weight of the solid acidic material at a temperature of about 25°-150° C. and subsequently filtering the product.

In order to remove the last traces of impurities from the (B-4b) reaction mixture, particularly when the adduct employed was prepared using a Lewis acid catalyst, (e.g., AlC13) it is sometimes desirable to add an organic inert solvent to the liquid reaction product and, after thorough mixing, to refilter the material. Subsequently the solvent is stripped from the (B-4b). Suitable solvents include solvents of the type mentioned hereinabove such as benzene, toluene, the higher alkanes, etc. A particularly useful class of solvents are the textile spirits.

In addition, other conventional purification techniques can be advantageously employed in purifying sulfurized products used in this invention. For example, commercial filter aids can be added to the materials prior to filtration to increase the efficiency of the filtration. Filtering through diatomaceous earth is particularly useful where the use contemplated requires the removal of substantially all solid materials. However, such expedients are well known to those skilled in the art and require no elaborate discussion herein.

B-5 The Metal Passivator

Function as a metal passivator are tolytriazole or an oil-soluble derivative of a dimercaptothiadiazole.

The dimercaptothiadiazoles which can be utilized in the present invention starting materials for the preparation of oil-soluble derivatives containing the dimercaptothiadiazole nucleus have the following structural formulae and names:

2,5-dimercapto-1,3,4-thiadiazole

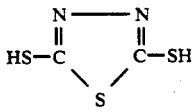

3,5-dimercapto-1,2,4-thiadiazole

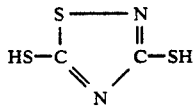

3,4-dimercapto-1,2,5-thiadiazole

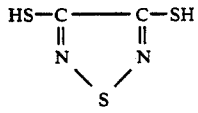

4,5-dimercapto-1,2,3-thiadiazole

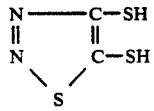

Of these the most readily available, and the one preferred for the purpose of this invention, is 2,5-dimercapto-1,3,4-thiadiazole. This compound will sometimes be referred to hereinafter as DMTD. However, it is to be understood that any of the other dimercaptothiadizoles may be substituted for all or a portion of the DMTD.

DMTD is conveniently prepared by the reaction of one mole of hydrazine, or a hydrazine salt, with two moles of carbon disulfide in an alkaline medium, followed by acidification.

Derivatives of DMTD have been described in the art, and any such compounds can be included in the compositions of the present invention. The preparation of some derivatives of DMTD is described in E.K. Fields "Industrial and Engineering Chemistry", 49, p. 1361-4 (September 1957). For the preparation of the oil-soluble derivatives of DMTD, it is possible to utilize already prepared DMTD or to prepare the DMTD in situ and subsequently adding the material to be reacted with DMTD.

U.S. Pat. Nos. 2,719,125; 2,719,126; and 3,087,937 describe the preparation of various 2,5-bis-(hydrocarbon dithio)-1,3,4-thiadiazoles. The hydrocarbon group may be aliphatic or aromatic, including cyclic, alicyclic, aralkyl, aryl and alkaryl. Such compositions are effective corrosion-inhibitors for silver, silver alloys and similar metals. Such polysulfides which can be represented by the following general formula

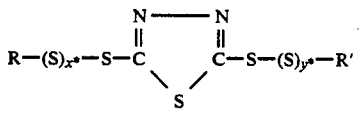

(XVII)

wherein R and R' may be the same or different hydrocarbon groups, and $x^*$ and $y^*$ be integers from 0 to about 8, and the sum of $x^*$ and $y^*$ being at least 1. A process for preparing such derivatives is described in U.S. Pat. No. 2,191,125 as comprising the reaction of DMTD with a suitable sulfenyl chloride or by reacting the dimercapto diathiazole with chlorine and reacting the resulting disulfenyl chloride with a primary or tertiary mercaptan. Suitable sulfenyl chlorides useful in the first procedure can be obtained by chlorinating a mercaptan (RSH or R'SH) with chlorine in carbon tetrachloride. In a second procedure, DMTD is chlorinated to form the desired bissulfenyl chloride which is then reacted with at least one mercaptan (RSH and/or R'SH). The disclosures of U.S. Pat. Nos. 2,719,125; 2,719,126; and 3,087,937 are hereby incorporated by reference for their description of derivatives of DMTD useful in the compositions of the invention.

U.S. Pat. No. 3,087,932 describes a one-step process for preparing 2,5-bis (hydrocarbyldithio)-1, 3,4-thiadiazole. The procedure involves the reaction of either DMTD or its alkali metal or ammonium salt and a mercaptan in the presence of hydrogen peroxide and a solvent. Oil-soluble or oil-dispersible reaction products of DMTD can be prepared also by the reaction of the DMTD with a mercaptan and formic acid. Compositions prepared in this manner are described in U.S. Pat. No. 2,749,311. Any mercaptan can be employed in the reaction although aliphatic and aromatic mono- or poly-mercaptan containing from 1 to 30 carbon atoms are preferred. The disclosures of U.S. Pat. Nos. 3,087,932 and 2,749,311 are hereby incorporated by reference for their description of DMTD derivatives which can be utilized as a metal passivator. Carboxylic esters of DMTD having the general formula

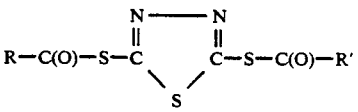

(XVIII)

wherein R and R' are hydrocarbon groups such as aliphatic, aryl and alkaryl groups containing from about 2 to about 30 or more carbon atoms are described in U.S. Pat. No. 2,760,933. These esters are prepared by reacting DMTD with an organic acid halide (chloride) and a molar ratio of 1:2 at a temperature of from about 25° to about 130° C. Suitable solvents such as benzene or dioxane can be utilized to facilitate the reaction. The reaction product is washed with dilute aqueous alkali to remove hydrogen chloride and any unreacted carboxylic acid. The disclosure of U.S. Pat. No. 2,760,933 is hereby incorporated by reference for its description of various DMTD derivatives which can be utilized in the compositions of the present invention.

Condensation products of alpha-halogenated aliphatic monocarboxylic acids having at least 10 carbon atoms with DMTD are described in U.S. Pat. No. 2,836,564. These condensation products generally are characterized by the following formula

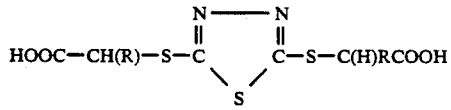

(XIX)

wherein R is an alkyl group of at least 10 carbon atoms. Examples of alpha-halogenated aliphatic fatty acids which can be used include alpha-bromo-lauric acid, alphachlorolauric acid, alpha-chloro-stearic acid, etc. The disclosure of U.S. Pat. No. 2,836,564 is hereby incorporated by reference for its disclosure of derivatives of DMTD which can be utilized in the compositions of the present invention.

Oil-soluble reaction products of unsaturated cyclic hydrocarbons and unsaturated ketones are described in U.S. Pat. Nos. 2,764,547 and 2,799,652, respectively, and a disclosure of these references also are hereby incorporated by reference for their description of materials which are useful as metal passivators in the compositions of the present invention. Examples of unsaturated cyclic hydrocarbons described in the '547 patent include styrene, alpha-methyl styrene, pinene, dipentene, cyclopentadiene, etc. The unsaturated ketones described in U.S. Pat. No. 2,799,652 include aliphatic, aromatic or heterocyclic unsaturated ketones containing from about 4 to 40 carbon atoms and from 1 to 6 double bonds. Examples include mesityl oxide, phorone, isophorone, benzal acetophenone, furfural acetone, difurfuryl acetone, etc.

U.S. Pat. No. 2,765,289 describes products obtained by reacting DMTD with an aldehyde and a diaryl amine in molar proportions of from about 1:1:1 to about 1:4:4. The resulting products are suggested as having the general formula

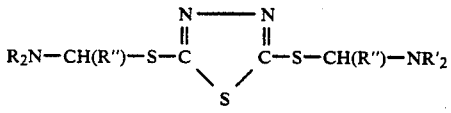

(XX)

wherein R and R' are the same or different aromatic groups, and R'' is hydrogen, and alkyl group, or an aromatic group. The aldehydes useful in the preparation of such products as represented by Formula X include aliphatic or aromatic aldehydes containing from 1 to 24 carbon atoms, and specific examples of such aldehydes include formaldehyde, acetaldehyde, benzaldehyde, 2-ethylehexyl aldehyde, etc. The disclosure of this patent also is hereby incorporated by reference for its identification of various materials which can be utilized in the compositions of this invention as metal passivators.

Metal passivators in the compositions of the present invention also may be amine salts of DMTD such as those having the following formula

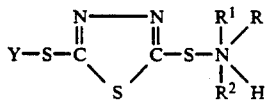

(XXI)

in which Y is hydrogen or the amino group

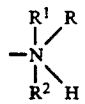

in which R is an aliphatic, aromatic or heterocyclic group, and $R^1$ and $R^2$ are independently aliphatic, aromatic or heterocyclic groups containing from about 6 to about 60 carbon atoms. The amine used in the preparation of the amine salts can be aliphatic or aromatic mono- or polyamines, and the amines may be primary, secondary or tertiary amines. Specific examples of suitable amines include hexylamine, dibutylamine, dodecylamine, ethylenediamine, propylenediamine, tetraethylenepentamine, and mixtures thereof. The disclosure of U.S. Pat. No. 2,910,439 is hereby incorporated by reference for its listing of suitable amine salts.

Dithiocarbamate derivatives of DMTD are described in U.S. Pat. Nos. 2,690,999 and 2,719,827. Such compositions can be represented by the following formulae

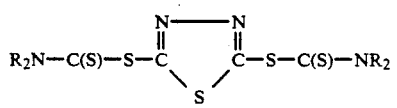

(XXII)

and

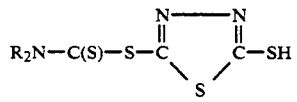

(XXIII)

wherein the R groups are straight-chain or branch-chain saturated or unsaturated hydrocarbon groups selected from the group consisting of alkyl, aralkyl and alkaryl groups. The disclosures of these two patents also are hereby incorporated by reference for the identification of various thiadiazyl dithiocarbamates which are useful as metal passivators in the compositions of the present invention.

U.S. Pat. No. 2,850,453 describes products which are obtained by reacting DMTD, an aldehyde and an alcohol or an aromatic hydroxy compound in a molar ratio of from 2:1 to 1:6:5. The aldehyde employed can be an aliphatic aldehyde containing from 1 to 20 carbon atoms or an aromatic or heterocyclic aldehyde containing from about 5 to about 30 carbon atoms. Examples of suitable aldehydes include formaldehyde, acetaldehyde, benzaldehyde. The reaction can be conducted in the presence or absence of suitable solvents by (a) mixing all of the reactants together and heating, (b) by first reacting an aldehyde with the alcohol or the aromatic 2 hydroxy compound, and then reacting the resultant intermediate with the thiadiazole, or (c) by reacting the aldehyde with thiadiazole first and the resulting intermediate with the hydroxy compound. The disclosure of U.S. Pat. No. 2,850,453 is hereby incorporated by reference for its metal passivators in the compositions of the present invention.

U.S. Pat. No. 2,703,784 describes products obtained by reacting DMTD with an aldehyde and a mercaptan. The aldehydes are similar to those disclosed in U.S. Pat. No. 2,850,453, and the mercaptans may be aliphatic or aromatic mono- or poly-mercaptans containing from about 1 to 30 carbon atoms. Examples of suitable mercaptans include ethyl mercaptan, butyl mercaptan, octyl mercaptan, thiophenol, etc. The disclosure of this patent also is incorporated by reference.

The preparation of 2-hydrocarbyldithio-5-mercapto-1,3,4-thiadiazoles having the formula

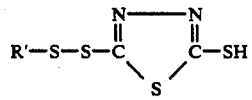

(XXIV)

wherein R' is a hydrocarbyl substituent is described in U.S. Pat. No. 3,663,561. The compositions are prepared by the oxidative coupling of equimolecular portions of a hydrocarbyl mercaptan and DMTD or its alkali metal mercaptide. The compositions are reported to be excellent sulfur scavengers and are useful in preventing copper corrosion by active sulfur. The mono-mercaptans used in the preparation of the compounds are represented by the formula

R'SH wherein R' is a hydrocarbyl group containing from 1 to about 280 carbon atoms. A peroxy compound, hypohalide or air, or mixtures thereof can be utilized to promote the oxidative coupling. Specific examples of the mono-mercaptan include methyl mercaptan, isopropyl mercaptan, hexyl mercaptan, decyl mercaptan, and long chain alkyl mercaptans, for example mercaptans derived from propene polymers and isobutylene polymers especially polyisobutylenes, having 3 to about 70 propene or isobutylene units per molecule. The disclosure of U.S. Pat. No. 3,663,561 is hereby incorporated by reference for its identification of DMTD derivative which are useful as metal passivators in the compositions of this invention.

Another material useful as metal passivators in the compositions of the present invention is obtained by reacting a thiadiazole, preferably DMTD with an oil-soluble dispersant, preferably a substantially neutral or acidic carboxylic dispersant in a diluent by heating the mixture above about 100° C. This procedure, and the derivatives produced thereby are described in U.S. Pat. No. 4,136,043, the disclosure of which is hereby incorporated by reference. The oil-soluble dispersants which are utilized in the reaction with the thiadiazoles are often identified as "ashless dispersants". Various types of suitable ashless dispersants useful in the reaction are described in '043 patent.

Another material useful as metal passivators in the compositions of the invention is obtained by reacting a thiadiazole, preferably DMTD, with a peroxide, preferably hydrogen peroxide. The resulting nitrogen- and sulfur-containing composition is then reacted with a polysulfide, mercaptan or amino compound (especially oil-soluble, nitrogen-containing dispersants). This procedure and the derivatives produced thereby are described in U.S. Pat. No. 4,246,126, the disclosure of which is incorporated herein by reference.

U.S. Pat. No. 4,140,643 describes nitrogen and sulfur-containing compositions which are oil-soluble and which are prepared by reacting a carboxylic acid or anhydride containing up to about 10 carbon atoms and having at least one olefinic bond with compositions of the type described in U.S. Pat. No. 4,136,043. The preferred carboxylic acid or anhydride is maleic anhydride. The disclosures of U.S. Pat. Nos. 4,136,043 and 4,140,643 are hereby incorporated by reference for their disclosures of materials useful as metal passivators in the compositions of the present invention.

U.S. Pat. No. 4,097,387 describes DMTD derivatives prepared by reacting a sulfur halide with an olefin to form an intermediate which is then reacted with an alkali metal salt of DMTD. More recently, U.S. Pat. No. 4,487,706 describes a DMTD derivative prepared by reacting an olefin, sulfur dichloride and DMTD in a one-step reaction. The olefins generally contain from about 6 to 30 carbon atoms. The disclosures of U.S. Pat. Nos. 4,097,387 and 4,487,706 are hereby incorporated by reference for their descriptions of oil-soluble DMTD derivatives which are useful as metal passivators in the compositions of this invention.

(C) The Viscosity Modifying Additive

This invention also contemplates utilizing (C) viscosity modifying compositions of two different types.

The first viscosity modifying compositions, (C-I), contemplates the provision of a nitrogen-containing ester of a carboxy-containing interpolymer, said interpolymer having a reduced specific viscosity of from about 0.05 to about 2, said ester being substantially free of tiltratable acidity and being characterized by the presence within its polymeric structure of at least one of each of three pendant polar groups: (A) a relatively high molecular weight carboxylic ester group having at least 8 aliphatic carbon atoms in the ester radical, (B) a relatively low molecular weight carboxylic ester group having no more than 7 aliphatic carbon atoms in the ester radical, and (C) a carbonyl-polyamino group derived from a polyamino compound having one primary or secondary amino group, wherein the molar ratio of (A):(B):(C) is (60–90):(10–30):(2–15)

An essential element of the viscosity modifying additive is that the ester is a mixed ester, i.e., one in which there is the combined presence of both a high molecular weight ester group and a low molecular weight ester group, particularly in the ratio as stated above. Such combined presence is critical to the viscosity properties of the mixed ester, both from the standpoint of its viscosity modifying characteristics and from the standpoint of its thickening effect upon lubricating compositions in which it is used as an additive.

In reference to the size of the ester groups, it is pointed out that an ester radical is represented by the formula $$-C(O)(OR)^{*}$$

and that the number of carbon atoms in an ester radical is this the combined total of the carbon atoms of the carbonyl group and the carbon atoms of the ester group i.e., the (OR) group.

Another essential element of (C-1) is the presence of a polyamino group derived from a particular polyamino compound, i.e., one in which there is one primary or secondary amino group and at least one mono-functional amino group. Such polyamino group, when present in the nitrogen-containing esters of (C-1) in the proportion stated above enhances the dispersability of such esters in lubricant compositions and additive concentrates for lubricant compositions.

Still another essential element of (C-1) is the extent of esterification in relation to the extent of neutralization of the unesterified carboxy groups of the carboxy-containing interpolymer through the conversion thereof to polyamino-containing groups. For convenience, the relative proportions of the high molecular weight ester group to the low molecular weight ester group and to the polyamino group are expressed in terms of molar ratios of (60–90):(10–30):(2–15), respectively. The preferred ratio is (70–80):(15–25):5. It should be noted that the linkage described as the carbonyl-polyamino group may be imide, amide, or amidine and inasmuch as any such linkage is contemplated within the present invention, the term "carbonyl polyamino" is thought to be a convenient, generic expression useful for the purpose of defining the inventive concept. In particularly advantageous embodiment of the invention such linkage is imide or predominantly imide.

Still another important element of (C-1) is the molecular weight of the carboxy-containing interpolymer. For convenience, the molecular weight is expressed in terms of the "reduced specific viscosity" of the interpolymer which is a widely recognized means of expressing the molecular size of a polymeric substance. As used herein, the reduced specific viscosity (abbreviated as RSV) is the value obtained in accordance with the formula $$RSV = \frac{\text{Relative Viscosity} - 1}{\text{Concentration}}$$

wherein the relative viscosity is determined by measuring, by means of a dilution viscometer, the viscosity of a solution of one gram of the interpolymer in 10 ml. of acetone and the viscosity of acetone at 30°±0.02° C. For purpose of computation by the above formula, the concentration is adjusted to 0.4 gram of the interpolymer per 100 ml. of acetone. A more detailed discussion of the reduced specific viscosity, also known as the specific viscosity, as well as its relationship to the average molecular weight of an interpolymer, appears in Paul J. Flory, *Principles of Polymer Chemistry,* (1953 Edition) pages 308 et seq.

While interpolymers having reduced specific viscosity of from about 0.05 to about 2 are contemplated in (C-1), the preferred interpolymers are those having a reduced specific viscosity of from about 0.3 to about 1. In most instances, interpolymers having a reduced specific viscosity of from about 0.5 to about 1 are particularly preferred.

From the standpoint of utility, as well as for commercial and economical reasons, nitrogen-containing esters in which the high molecular weight ester group has from 8 to 24 aliphatic carbon atoms, the low molecular weight ester group has from 3 to 5 carbon atoms, and the carbonyl polyamino group is derived from a primary-aminoalkyl-substituted tertiary amine, particularly heterocyclic amines, are preferred. Specific examples of the high molecular weight carboxylic ester group, i.e., the (OR) group of the ester radical (i.e., —(O)(OR)) include heptyloxy, isooctyloxy, decyloxy, dodecyloxy, tridecyloxy, tetradecyloxy, pentadecyloxy, octadecyloxy, eicosyloxy, tricosyloxy, tetracosyloxy, etc. Specific examples of low molecular weight groups include methoxy, ethoxy, n-propyloxy, isopropyloxy, n-butyloxy, sec-butyloxy, iso-butyloxy, n-pentyloxy, neo-pentyloxy, n-hexyloxy, cyclohexyloxy, xyxlopentyloxy, 2-methyl-butyl-1-oxy, 2,3-dimethyl-butyl-1-oxy, etc. In most instances, alkoxy groups of suitable size comprise the preferred high and low molecular weight ester groups. Polar substituents may be present in such ester groups. Examples of polar substituents are chloro, bromo, ether, nitro, etc.

Examples of the carbonyl polyamino group include those derived from polyamino compounds having one primary or secondary amino group and at least one mono-functional amino group such as tertiary-amino or heterocyclic amino group. Such compounds may thus be tertiary-amino substituted primary or secondary amines or other substituted primary or secondary amines in which the substituent is derived from pyrroles, pyrrolidones, caprolactams, oxazolidones, oxazoles, thiazoles, pyrazoles, pyrazolines, imidazoles, imidazolines, thiazines, oxazines, diazines, oxycarbamyl, thiocarbamyl, uracils, hydantoins, thiohydantoins, guanidines, ureas, sulfonamides, phosphoramides, phenolthiaznes, amidines, etc. Examples of such polyamino compounds include dimethylaminoethylamine, dibutylamino-ethylamine, 3-dimethylamino-1-propylamine, 4-methylethylamino-1- butylamine, pyridylethylamine, N-morpholino-ethylamine, tetrahydropyridylethylamine, bis-(dimethylamino)propylamine, bis(diethylamino)ethylamine, N,N-dimethyl-p-phenylene diamine, piperidyl-ethylamine, 1-aminoethyl pyrazole, 1-(methylamino)pyrazoline, 1-methyl-4-amino-octyl pyrazole, 1-aminobutyl imidazole, 4-aminoethyl thiazole, 2-aminoethyl pyridine, ortho-amino-ethyl-N,N-dimethylbenzenesulfamide, N-aminoethyl phenothiazine, N-aminoethylacetamidine, 1-aminophenyl-2-aminoethyl pyridine, N-methyl-N-aminoethyl-S-ethyl-dithiocarbamate, etc. Preferred polyamino compounds include the N-aminoalkyl-substituted morpholines such as aminopropyl morpholine. For the most part, the polyamino compounds are those which contain only one primary-amino or secondary-amino group and, preferably at least one tertiary-amino group. The tertiary amino group is preferably a heterocyclic amino group. In some instances polyamino compounds may contain up to about 6 amino groups although, in most instances, they contain one primary amino group and either one or two tertiary amino groups. The polyamino compounds may be aromatic or aliphatic amines and are preferably heterocyclic amines such as amino-alkyl-substituted morpholines, piperazines, pyridines, benzopyrroles, quinolines, pyrroles, etc. They are usually amines having from 4 to about 30 carbon atoms, preferably from 4 to about 12 carbon atoms. Polar substituents may likewise be present in the polyamines.

The carboxy-containing interpolymers include principally interpolymers of alpha, beta-unsaturated acids or anhydrides such as maleic anhydride or itaconic anhydride with olefins (aromatic or aliphatic) such as ethylene, propylene, styrene, or isobutene. The styrene-maleic anhydride interpolymers are especially useful. They are obtained by polymerizing equal molar amounts of styrene and maleic anhydride, with or without one or more additional interpolymerizable comonomers. In lieu of styrene, and aliphatic olefin may be used, such as ethylene, propylene or isobutene. In lieu of maleic anhydride, acrylic acid or methacrylic acid or ester thereof may be used. Such interpolymers are know in the art and need not be described in detail here. Where an interpolymerizable comonomer is contemplated, it should be present in a relatively minor proportion, i.e., less that about 0.3 mole, usually less than about 0.15 mole, per mole of either the olefin (e.g. styrene) or the alpha, beta-unsaturated acid or anhydride (e.g. maleic anhydride). Various methods of interpolymerizing styrene and maleic anhydride are known in the art and need not be discussed in detail here. For purpose of illustration, the interpolymerizable comonomers include the vinyl monomers such as vinyl acetate, acrylonitrile, methylacrylate, methylmethacrylate, acrylic acid, vinyl methyl either, vinyl ethyl ether, vinyl chloride, isobutene or the like.

The nitrogen-containing esters of (C-1) are most conveniently prepared by first esterifying the carboxy-containing interpolymer with a relatively high molecular weight alcohol and a relatively low molecular weight alcohol to convert at least about 50% and no more than about 98% of the carboxy radicals of the interpolymer to ester radicals and then neutralizing the remaining carboxy radicals with a polyamino compound such as described above. To incorporate the appropriate amounts of the two alcohol groups into the interpolymer, the ratio of the high molecular weight alcohol to the low molecular weight alcohol used in the process should be within the range of from about 2:1 to about 9:1 on a molar basis. In most instances the ratio is from about 2.5:1 to about 5:1. More than one high molecular weight alcohol or low molecular weight alcohol may be used in the process; so also may be used commercial alcohol mixtures such as the so-called Oxoalcohols which comprise, for example mixtures of alcohols having from 8 to about 24 carbon atoms. A particularly useful class of alcohols are the commercial alcohols or alcohol mixtures comprising decylalcohol, dodecyl alcohol, tridecyl alcohol, tetradecyl alcohol, pentadecyl alcohol, hexadecyl alcohol, heptadecyl alcohol and octadecyl alcohol. Other alcohols useful in the process are illustrated by those which, upon esterification, yield the ester groups exemplified above.

The extent of esterification, as indicated previously, may range from about 50% to about 98% conversion of the carboxy radicals of the interpolymer to ester radicals. In a preferred embodiment, the degree of esterification ranges from about 75% to about 95%.

The esterification can be accomplished simply be heating the carboxy-containing interpolymer and the alcohol or alcohols under conditions typical for effecting esterification. Such conditions usually include, for example, a temperature of at least about 80° C., preferably from about 150° C. to about 350° C., provided that the temperature be below the decomposition point of the reaction mixture, and the removal of water of esterification as the reaction proceeds. Such conditions may optionally include the use of an excess of the alcohol reactant so as to facilitate esterification, the use of a solvent or diluent such as mineral oil, toluene, benzene, xylene or the like and a esterification catalyst such as toluene sulfonic acid, sulfuric acid, aluminum chloride, boron trifluoride=triethylamine, hydrochloric acid, ammonium sulfate, phosphoric acid, sodium methoxide or the like. These conditions and variations there of are well know in the art.

A particularly desirable method of effecting esterification involves first reacting the carboxy-containing interpolymer with the relatively high molecular weight alcohol and then reacting the partially esterified interpolymer with the relatively low molecular weight alcohol. A variation of this technique involves initiating the esterification with the relatively high molecular weight alcohol and before such esterification is complete, the relatively low molecular weight alcohol is introduced into the reaction mass so as to achieve a mixed esterification. In either event it has been discovered that a two-step esterification process whereby the carboxy-containing interpolymer is first esterified with the relatively high molecular weight alcohol so as to convert from about 50% to about 75% of the carboxy radicals to ester radicals and then with the relatively low molecular weight alcohol to achieve the finally desired degree of esterification results in products which have unusually beneficial viscosity properties.

The esterified interpolymer is then treated with a polyamino compound in an amount so as to neutralize substantially all of the unesterified carboxy radicals of the interpolymer. The neutralization is preferably carried out at a temperature of at least about 80° C., often from about 120° C. to about 300° C., provided that the temperature does not exceed the decomposition point of the reaction mass. In most instances the neutralization temperature is between about 150° C. and 250° C. a slight excess of the stoichiometric amount of the polyamino compound is often desirable, so as to insure substantial completion of neutralization, i.e., no more than about 2% of the carboxy radicals initially present in the interpolymer remained unneutralized.

The following examples are illustrative of the preparation of (C-1) of the present invention. Unless otherwise indicated all parts and percentages are by weight.

EXAMPLE (C-1)-1

A styrene-maleic interpolymer is obtained by preparing a solution of styrene (16.3 parts by weight) and maleic anhydride (12.9 parts) in a benzene-toluene solution (270 parts; weight ratio of benzene:toluene being 66.5:33.5) and contacting the solution at 86° C. in nitrogen atmosphere for 8 hours with a catalyst solution prepared by dissolving 70% benzoyl peroxide (0.42 part) in a similar benzene-toluene mixture (2.7 parts). The resulting product is a thick slurry of the interpolymer in the solvent mixture. To the slurry there is added mineral oil (141 parts) while the solvent mixture is being distilled off at 150° C. and then at 150° C./200 mm. Hg. To 209 parts of the stripped mineral oil-interpolymer slurry (the interpolymer having a reduced specific viscosity of 0.72) there are added toluene (25.2 parts), n-butyl alcohol (4.8 parts), a commercial alcohol consisting essentially of primary alcohols having from 12 to 18 carbon atoms of primary alcohols having from 12 to 18 carbon atoms (56.6 parts) and a commercial alcohol consisting of primary alcohols having from 8 to 10 carbon atoms (10 parts) and to the resulting mixture there is added 96% sulfuric acid (2.3 parts). The mixture is then heated at 150°-160° C. for 20 hours whereupon water is distilled off. An additional amount of sulfuric acid (0.18 part) together with an additional amount of n-butyl alcohol (3 parts) is added and the esterification is continued until 95% of the carboxy radicals of the polymer has been esterified. To the esterified interpolymer, there is then added aminopropyl morpholine (3.71 parts; 10% in excess of the stoichiometric amount required to neutralize the remaining free carboxy radicals) and the resulting mixture is heated to 150°-160° C./10 mm. Hg to distill off toluene and any other volatile components. The stripped product is mixed with an additional amount of mineral oil (12 parts) filtered. The filtrate is a mineral oil solution of the nitrogen-containing mixed ester having a nitrogen content of 0.16-0.17%.

EXAMPLE (C-1)-2

The procedure of Example (C-1)-1 is followed except that the esterification is carried out in two steps, the first step being the esterification of the styrene-maleic interpolymer with the commercial alcohols having from 8 to 18 carbon atoms and the second step being the further esterification of the interpolymer with n-butyl alcohol.

EXAMPLE (C-1)-3

The procedure of Example (C-1)-1 is followed except that the esterification is carried out by first esterifying the styrene-maleic interpolymer with the commercial alcohol having from 8 to 18 carbon atoms until 70% of the carboxyl radicals of the interpolymer have been converted to ester radicals and thereupon continuing the esterification with any yet-unreacted commercial alcohols and n-butyl alcohol until 95% of the carboyle radicals of the interpolymer have been converted to ester radicals.

EXAMPLE (C-1)-4

The procedure of Example (C-1)-1 is followed except that the interpolymer is prepared by polymerizing a solution consisting of styrene (416 parts), maleic anhydride (392 parts), benzene (2153 parts) and toluene (5025 parts) in the presence of benzoyl peroxide (1.2 parts) at 65°-106° C. (The resulting interpolymer has a reduced specific viscosity of 0.45)

EXAMPLE (C-1)-5

The procedure of Example (C-1)-1 is followed except that the styrene-maleic anhydride is obtained by polymerizing a mixture of styrene (416 parts), maleic anhydride (392 parts), benzene (6101 parts) and toluene (2310 parts) in the presence of benzoyl peroxide (1.2 parts) at 78°-92° C. (The resulting interpolymer has a reduced specific viscosity of 0.91)

EXAMPLE (C-1)-6

The procedure of Example (C-1)-1 is followed except that the styrene-maleic anhydride is prepared by the following procedure: Maleic anhydride (392 parts) is dissolved in benzene (6870 parts). To this mixture there is added styrene (416 parts) at 76° C. whereupon benzoyl peroxide (1.2 parts) is added. The polymerization mixture is maintained at 80°-82° C. for about 5 hours. (The resulting interpolymer has a reduced specific viscosity of 1.24.)

EXAMPLE (C-1)-7

The procedure of Example (C-1)-1 is followed except that acetone (1340 parts) is used in place of benzene as the polymerization solvent and that azobisisobutyronitrile (0.3 part) is used in place of benzoyl peroxide as a polymerization catalyst.

EXAMPLE (C-1)-8

An interpolymer (0.86 carboxyl equivalent) of styrene and maleic anhydride (prepared from an equal molar mixture of styrene and maleic anhydride and having a reduced specific viscosity of 0.67–0.68) is mixed with mineral oil to form a slurry, and then esterified with a commercial alcohol mixture (0.77 mole; comprising primary alcohols having from 8 to 18 carbon atoms) at 150°–160° C. in the presence of a catalytic amount of sulfuric acid until about 70% of the carboxyl radicals are converted to ester radicals. The partially esterified interpolymer is then further esterified with a n-butyl alcohol (0.31 mole) until 95% of the carboxyl radicals of the interpolymer are converted to the mixed ester radicals. The esterified interpolymer is then treated with aminopropyl morpholine (slight excess of the stoichiometric amount to neutralize the free carboxyl radicals of the interpolymer) at 150°–160° C. until the resulting product is substantially neutral (acid number of 1 to phenolphthalein indicator). the resulting product is mixed with mineral oil so as to form an oil solution containing 34% of the polymeric product.

The second viscosity modifying composition (C-2) is similar to (C-1) in all respects except that the carboxy containing interpolymer has a reduced specific viscosity of from about 0.05 to about 1 and being characterized by the presence within its polymeric structure of at least one of each of the following groups which are derived from the carboxy groups of said interpolymer:

(A') a carboxylic ester group, said carboxylic ester group having at least eight aliphatic carbon atoms in the ester radical, and (B') a carbonyl-polyamino group derived from a polyamino compound having one primary or secondary amino group and at least one monofunctional amino group, wherein the molar ration of carboxy groups of said interpolymer esterified to provide (A') to carboxy groups of said interpolymer neutralized to provide (B') is in the range of about 85:15 to about 99:1.

The (A') of (C-2) is the same as the (A) of (C-1) and the (B') of (C-2) is the same as the (C) of (C-1).

The following examples are illustrative of the preparation of (C-2) of the present invention. Unless otherwise indicated all parts and percentages are by weight.

EXAMPLE (C-2)-1

A styrene-maleic interpolymer is obtained by preparing a solution of styrene (536 parts) and maleic anhydride (505 parts) in toluene (7585 parts) and contacting the solution at a temperature of 99°–101° C. and an absolute pressure of 480–535 mm. Hg. with a catalyst solution prepared by dissolving benzoyl peroxide (2.13 parts) in toluene 51.6 parts). The catalyst solution is added over a period of 1.5 hours with the temperature maintained at 99°–101° C. Mineral oil 2496 parts is added to the mixture. The mixture is maintained at 99°–101° C. and 480–535 mm Hg. for 4 hours. The resulting product is a slurry of the interpolymer in the solvent mixture. The resulting interpolymer has a reduced specific viscosity of 0.42.

EXAMPLE (C-2)-2

A toluene slurry (2507 parts), having 11.06% solids and 88.94% volatiles, of the maleic anhydride/styrene interpolymer of Example (C-2)-1, Neodol 45 (632 parts), a product of Shell Chemical Company identified as a mixture of C14 and C15 linear primary alcohols, mineral oil (750 parts), and Ethyl Antioxidant 733 (4.2 parts), a product of Ethyl identified as an isomeric mixture of butyl phenols, are charged to a vessel. The mixture is heated with medium agitation under nitrogen purge at 0.5 standard cubic feet per hour until the temperature reaches 115° C. 70 % methane sulfonic acid catalyst in water (10.53 parts) is added dropwise over a period of 20 minutes. Nitrogen purge is increased to 1.0 standard cubic feet per hour and temperature is raised by removal of toluene-water distillate. The mixture is maintained at a temperature of 150° C. for five hours under a nitrogen purge of 0.1–0.2 standard cubic feet per hour. Additional methane sulfonic acid solution (15.80 parts) is added to the mixture over period of 15 minutes. The mixture is maintained at 150° C. for 3.5 hours. The degree of esterification is 95.08%. Amino propylmorpholine (35.2 parts) is added to the mixture dropwise over a period of 20 minutes. The mixture is maintained at 150° C. for an additional 30 minutes then cooled with stirring. The mixture is stripped from 50° C. to 141° C. at a pressure of 102 mm.Hg. then permitted to cool. At a temperature of 100° C., mineral oil (617 parts) is added. Cooling is continued to 60° C. At 60° C., diatomaceous earth (36 parts) is added and the mixture is heated to 100° C. The mixture is maintained at 100°–105° C. for one hour with stirring and then filtered to yield the desired product.

EXAMPLE (C-2)-3

The procedure of Example (C-2)-2 is repeated with the exception that both Neodol 45 (315.4 parts) and Alfol 1218 (312.5 parts), a product of Continental Oil Company identified as a mixture of synthetic primary straight chain alcohols having 12 to 18 carbon atoms, are initially charged, rather than the 631 parts of Neodol 45 which were included in the initial charge in Example 2.

EXAMPLE (C-2)-4

A toluene slurry (1125 parts), having 13.46% solids and 86.54% volatiles, of the maleic anhydride/styrene interpolymer of Example (C-2)-1, mineral oil (250 parts) and Neodol 45 (344 parts) are charged to a vessel. The mixture is heated with medium agitation under nitrogen sweep of 0.5 standard cubic feet per hour until the temperature reaches 110° C. Paratoluene sulfonic acid (8.55 parts) in water 9 parts) is added dropwise over a period of 24 minutes. The temperature of the mixture is increased to 152° C. by removing toluene-water distillate. The temperature is maintained at 152°–156° C. under nitrogen sweep of 0.5 standard cubic feet per hour until the net acid number indicates that esterification is at least 95% complete. Aminopropylmorpholine (15.65 parts) is added dropwise over a period of 10 minutes. The temperature of the mixture is maintained at 155° C. for 1 hour and then cooled under a nitrogen sweep. Ethyl Antioxidant 733 (1.48 parts) is added to the mixture. The mixture is stripped at 143° C. and 99 mm. Hg. pressure. The mixture is cooled under nitrogen sweep. Mineral oil is added to provide a total 63% dilution. Ethyl Antioxidant 733 (1.79 parts) is added and the mixture is stirred for 30 minutes. The mixture is heated 60° C. while stirring with a nitrogen sweep of 0.5 standard cubic feet per hour. Diatomaceous earth (18 parts) is added to the mixture. The mixture is heated to 90° C. The temperature of the mixture is maintained at 90°–100° C. for 1 hour and then filtered through a pad of diatomaceous earth (18 parts) in a heated funnel to yield the desired product.

EXAMPLE (C-2)-5

The procedure of Example (C-2)-4 is repeated with the exception that both Neodol 45 (172 parts) and Alfol 1218 (169 parts) are provided in the initial charge, rather than the 344 parts of Neodol 45 provided in Example 4.

EXAMPLE (C-2)6

The product of Example (C-2)-1 (101 parts, Neodol 91 (56 parts(, a product of Shell Chemical Company identified as a mixture of C9, C10, and C11 alcohols, TA-1618 (92 parts), a product of Procter & Gamble identified as a mixture of C16 and C18 alcohols, Neodol 25 (62 parts), a product Shell Chemical Company identified as a mixture of C12, C13, C14, and C15 alcohols, and toluene (437 parts) are charged to a vessel. The vessel is stirred and the contents are heated. Methane sulfonic acid (5 parts) is added to the mixture. The mixture is heated under reflux conditions for 30 hours. Aminopropyl morpholine (12.9 parts) is added to the mixture. The mixture is heated under reflux conditions for an additional 4 hours. Diatomaceous earth (30 parts) and a neutral paraffinic oil (302 parts) are added to the mixture which is then stripped. The residue is filtered to yield 497.4 parts of an orange-brown viscous liquid.

EXAMPLE (C-2)-7

The product of Example (C-2)-1 (202 parts), Neodol 91 (112 parts), TA 1618 (184 parts), Neodol 25 (124 parts and toluene (875 parts) are charged to a vessel. The mixture is heated and stirred. Methane sulfonic acid (10 parts) is added to the mixture which is then heated under reflux conditions for 31 hours. Aminopropyl morpholine (27.91 parts) is added to the mixture which is then heated under reflux conditions for an additional 5 hours. Diatomaceous earth (60 parts) is added to the mixture which is then stripped, 600 parts o polymer remaining in the vessel. A neutral paraffinic oil (600 parts) is added to the mixture which is then homogenized. The mixture is filtered through a heated funnel to yield 1063 parts of a clear orange-brown viscous liquid.

EXAMPLE (C-2)-8

The product of Example (C-2)-1 (101 parts), Alfol 810 (50 parts), a product of Continental Oil Company identified as a mixture of C8 and C10 alcohols, TA-1618 (92 parts), Neodol 25 (62 parts) and toluene (437 parts) are charged to a vessel. The mixture is heated and stirred. Methane sulfonic acid (5 parts) is added to the mixture which is heated under reflux conditions for 30 hours. Aminopropyl morpholine (15.6 parts) is added to the mixture which is then heated under reflux conditions for an additional 5 hours. The mixture is stripped to yield 304 parts of a yellow-orange viscous liquid. Diatomaceous earth (30 parts) and a neutral paraffinic oil (304 parts) are added to the mixture which is then homogenized. The mixture is filtered through a heated funnel to yield 511 parts of a clear amber viscous liquid.

EXAMPLE (C-2)-9

A toluene slurry (799 parts) of a maleic anhydride/styrene interpolymer (17.82% polymer) is charged to a vessel. The reduced specific viscosity of the interpolymer is 0.69. The vessel is purged with nitrogen while stirring the contents for 15 minutes. Alfol 1218 (153 parts), Neodol 45 (156 parts) and 93% sulfuric acid (5 parts) are added to the mixture. Toluene (125 parts) is then added to the mixture. The mixture is heated at 150°-156° C. for 18 hours. Aminopropyl morpholine (1.3 parts) is added to the mixture which is then heated for an additional 1 hour at 150° C. The mixture is cooled to 80° C. Ethyl Antioxidant 733 (1.84 parts) is added to the mixture. The mixture is stripped at 143° C. and 100 mm.Hg. Mineral oil (302 parts) and Ethyl Antioxidant 733 (2.5 parts) is added to the mixture while the mixture is stirred. Diatomaceous earth (25 parts) is added to the mixture. The temperature of the mixture is maintained at 70° C. for 45 minutes and then heated to 110° C. Diatomaceous earth (25 parts) is added to the mixture. The mixture is filtered through diatomaceous earth to yield the desired product.

EXAMPLE (C-2)-10

A toluene and mineral oil slurry (699 parts) containing 17.28% solids of a maleic anhydride/styrene interpolymer (reduced specific viscosity of 0.69), Neodol 45 (139 parts), Alfol 1218 (138 parts), Ethyl Antioxidant 733 (2.9 parts) and toluene (50 parts) are charged to a vessel. The mixture is heated under a nitrogen purge at 0.5 standard cubic feet per hour. 70% methane sulfonic acid (3.9 parts) is added dropwise over a period of 9 minutes. The mixture is heated under reflux conditions for 35 minutes. Toluene (51 parts) is added to the mixture which is then heated for an additional 3 hours 15 minutes under reflux conditions. 70% methane sulfonic acid (3 parts) is added dropwise over a period of 3 minutes. The mixture is heated under reflux conditions for 3 hours 15 minutes. 70% methane sulfonic acid (3.9 parts) is added dropwise over a period of 12 minutes. The mixture is heated at 150°-152° C. for 3 hours 45 minutes. Aminopropyl morpholine (14.3 parts) is added to the mixture dropwise over a period of 15 minutes. The mixture is maintained at a temperature of 149°-150° C. for an additional 30 minutes. The mixture is stripped at 140° C. and 100 mm.Hg. The mixture is cooled to 50° C. Mineral oil (338 parts) and diatomaceous earth (19 parts) are added to the mixture. The temperature of the mixture is maintained at 100°-105° C. for 1.5 hours and then filtered through additional diatomaceous earth (18 parts) to yield the desired product.

D A Synthetic Ester Base Oil

Components (A), (B) and (C) may further comprise component (D) a synthetic ester base oil. The synthetic ester base oil comprises the reaction of a monocarboxylic acid of the formula $$R^{16}COOH$$

or a dicarboxylic acid of the formula $$\begin{array}{l} R^{17}-CHCOOH \\ \quad\;\; (CH_2)m \\ \quad\;\; CH_2COOH \end{array}$$

with an alcohol of the formula $$R^{18}(OH)_n$$

wherein $R^{16}$ is a hydrocarbyl group containing from about 5 to about 12 carbon atoms, $R^{17}$ is hydrogen or a hydrocarbyl group containing from about 4 to about 50 carbon atoms, $R^{18}$ is a hydrocarbyl group containing from 1 to about 18 carbon atoms, m is an integer of from 0 to about 6 and n is an integer of from 1 to about 6.

Useful monocarboxylic acids are the isomeric carboxylic acids of pentanoic, hexanoic, octanoic, nonanoic, decanoic, undecanoic and dodecanoic acids. When $R^{17}$ is hydrogen, useful dicarboxylic acids are succinic acid, maleic acid, azelaic acid, suberic acid, sebacic acid, fumaric acid and adipic acid. When $R^{17}$ is a hydrocarbyl group containing from 4 to about 50 carbon atoms, the useful dicarboxylic acids are alkyl succinic acids and alkenyl succinic acids. Alcohols that may be employed are methyl alcohol, ethyl alcohol, butyl alcohol, the isomeric pentyl alcohols, the isomeric hexyl alcohols, dodecyl alcohol, 2-ethylhexyl alcohol, ethylene glycol, diethylene glycol, propylene glycol, neopentyl glycol, pentaerythritol, dipentaerythritol, etc. Specific examples of these esters include dibutyl adipate, di(2-ethyhexyl) sebacate, di-n-hexyl fumarate, dioctyl sebacate, diisooctyl azelate, diisodecyl azelate, dioctylphthalate, didecyl phthalate, dieicosyl sebacate, the 2-ethylhexyl diester of linoleic acid dimer, the complex ester formed by reacting one mole of sebacic acid with two moles tetraethylene glycol and two moles of 2-ethylhexanoic acid, the ester formed by reacting one mole of adipic acid with 2 moles of a 9 carbon alcohol derived from the oxo process of a 1-butene dimer and the like.

The compositions of the present invention comprising components (A), (B) and (C) or (A), (B), (C) and (D) are useful as a multipurpose power transmission fluid. The following states the ranges of components (A), (B), (C) and (D) in parts by weight

| Component | Generally | Preferred | Most Preferred |
|---|---|---|---|
| (A) | 60–90 | 65–90 | 65–85 |
| (B) | 1–12 | 10–10 | 2–5 |
| (C) | 1–8 | 1–6 | 1–4 |
| (D) | 0–25 | 0–23 | 0–20 |

It is understood that other components besides (A), (B), (C) and (D) may be present within this multipurpose power transmission fluid.

Component (B) comprises (B-1), (B-2), (B-3), (B-4) and (B-5). The following states the ranges of those sub components as a function of the range of (B).

| Sub Component | Generally | Preferred | Most Preferred |
|---|---|---|---|
| (B-1) | 0.9–3.0 | 1.4–2.5 | 1.4–2.3 |
| (B-2) | 0.05–3.0 | 0.1–2.5 | 0.1–2.2 |
| (B-3) | 0.02–2.0 | 0.04–1.7 | 0.04–1.5 |
| (B-4) | 0.02–3.0 | 0.04–1.7 | 0.04–1.5 |
| (B-5) | 0.01–1.0 | 0.02–1.6 | 0.02–1.5 |

The following Table II outlines examples so as to provide those of ordinary skill in the art with a complete disclosure and description on how to make the functional fluid of this invention and are not intended to limit the scope of what the inventor regards as his invention. All parts are by weight.

TABLE II

| | Example Number | | | | | | | | | |
|---|---|---|---|---|---|---|---|---|---|---|
| Ingredients | 1 | 2 | 3 | 4 | 5 | 6 | 7 | 8 | 9 | 10 |
| Rapeseed oil | 74.22 | | 74.18 | 74.26 | 73.3 | 73.78 | 74.18 | 73.54 | 74.26 | 74.66 |
| Synthetic fluid di 2-ethylhexyl alcohol/azelaic acid (2/1)m 1-butene dimer oxoalcohol/adipic acid (2/1)m | 18.56 | 18.56 | 18.55 | 18.57 | 18.33 | 18.45 | 18.55 | 18.39 | 18.57 | 18.67 |
| Foam inhibitor | 0.02 | 0.02 | 0.02 | 0.02 | 0.02 | 0.02 | 0.02 | 0.02 | 0.02 | 0.02 |
| Example (C-2)-2 | 0.5 | 0.5 | 0.5 | 0.5 | 0.5 | 0.5 | 0.5 | 0.5 | 0.5 | 0.5 |
| Example (C-1)-1 | 2.75 | 2.75 | 2.75 | 2.75 | 2.75 | 2.75 | 2.75 | 2.75 | 2.75 | 2.75 |
| Example (B-1)-5 | 0.5 | 0.5 | 0.5 | 0.5 | 0.5 | 0.5 | 0.5 | 0.5 | 0.5 | 0.5 |
| Propylenetetramer phenol/$S_2Cl_2$ (4:3)m | 0.5 | 0.5 | 0.5 | 0.5 | 0.5 | 0.5 | 0.5 | 0.5 | 0.5 | 0.5 |
| Calcium overbased salicylate | 0.5 | 0.5 | 0.95 | 0.05 | 0.95 | 0.95 | 0.95 | 0.05 | 0.05 | 0.05 |
| Example (B-2)-7 | 0.5 | 0.5 | 0.1 | 0.9 | 0.9 | 0.9 | 0.1 | 0.1 | 0.9 | 0.1 |
| Example (B-2)-8 | 0.5 | 0.5 | 0.5 | 0.5 | 0.5 | 0.5 | 0.5 | 0.5 | 0.5 | 0.5 |
| Example 4-b)-5 | 0.25 | 0.25 | 0.4 | 0.4 | 0.4 | 0.1 | 0.1 | 0.1 | 0.1 | 0.4 |
| N,N-diphenylamine | 0.2 | 0.2 | 0.2 | 0.2 | 0.2 | 0.2 | 0.2 | 0.2 | 0.2 | 0.2 |
| Oleamide-linoleomide mixture | 0.25 | 0.25 | 0.25 | 0.25 | 0.25 | 0.25 | 0.25 | 0.25 | 0.25 | 0.25 |
| Example (B-4a)-1 | 0.25 | 0.25 | 0.1 | 0.1 | 0.4 | 0.1 | 0.4 | 0.1 | 0.4 | 0.4 |
| DMTD/formaldehyde/heptylphenol | 0.5 | 0.5 | 0.5 | 0.5 | 0.5 | 0.5 | 0.5 | 0.5 | 0.5 | 0.5 |

What is claimed is:

1. A functional fluid composition, comprising:

(A) from about 60–90% by weight of at least one triglyceride;

(B) from about 1–12% by weight of at least one detergent-inhibitor additive free from phosphorus and zinc and comprising at least one metal overbased composition B-1 and/or at least one carboxylic dispersant composition B-2, diaryl amine B-3, sulfurized composition B-4, and metal passivator B-5; and (C) from about 1–8% by weight of at least one viscosity modifying additive comprising a nitrogen-containing mixed ester characterized by low-temperature viscosity modifying properties of a carboxy-containing interpolymer, said interpolymer having a reduced specific viscosity of from about 0.05 to about 2 and being derived from at least two monomers, one of said monomers being a low molecular weight aliphatic olefin or styrene and the other of said monomers being an alpha, beta-unsaturated aliphatic acid, anhydride or ester thereof, said nitrogen-containing ester being substantially free of titratable acidity and being characterized by the presence within its polymeric structure of at least one of each of three pendant polar groups which are derived from the carboxy groups of said nitrogen containing ester:

(A) a relatively high molecular weight carboxylic ester group, said carboxylic ester group having at least 8 aliphatic carbon atoms in the ester radical, (B) a relatively low molecular weight carboxylic ester group having no more than 7 aliphatic carbon atoms in the ester radical, (C) a carbonyl-polyamino group derived from a polyamino compound having one primary or secondary amino group, wherein the molcar ratio of (A):(B):(C) is 60–90):(10–30):(2–15) or a nitrogen-containing ester of a carboxy-containing interpolymer, said interpolymer having a reduced specific viscosity of from about 0.05 to about 1 and being derived from at least two monomers, one of said monomers being a low molecular weight aliphatic olefin or sytrene and the other of said monomers being an alpha, beta-unsaturated aliphatic acid, anhydride or ester thereof, said nitrogen-containing ester being substantially free of titratable acidity and being characterized by the presence within its polymeric structure of each of the following groups which are derived from the carboxy groups of said interpolymer:

(A') a carboxylic ester group, said carboxylic ester group having at least eight aliphatic carbon atoms in the ester radical, and (B') a carbonyl-polyamino group derived from a polyamino compound having one primary or secondary amino group and at least one monofunctional amino group, wherein the molar ratio of carboxy groups of said interpolymer esterified to provide (A') to carboxy groups of said interpolymer neutralized to provide (B') is in the range of about 85:15 to about 99:1.

2. The composition of claim 1 wherein the triglyceride is a naturally occurring triglyceride.

3. The composition of claim 2 wherein the naturally occurring triglyceride is an ester of a straight chain fatty acid and glycerol wherein the fatty acid contains from about 8 to about 22 carbon atoms.

4. The composition of claim 3 wherein the fatty acid of the triglyceride contains from about 12 to about 22 carbon atoms.

5. The composition of claim 4 where the triglyceride comprises rapeseed oil.

6. The composition of claim 1 wherein the metal overbased composition is a metal overbased sulfonate derived from an alkylated aryl sulfonic acid wherein the alkyl group has at least 15 aliphatic carbon atoms.

7. The composition of claim 6 wherein the metal is an alkali or alkaline earth metal.

8. The composition of claim 7 wherein the alkaline earth metal is calcium or magnesium.

9. The composition of claim 7 wherein the alkali metal is sodium.

10. The composition of claim 9 wherein the overbased sulfonate is treated with a borating agent.

11. The composition of claim 1 wherein the metal overbased composition is a metal overbased carboxylate derived from fatty acids having at least 8 aliphatic carbon atoms.

12. The composition of claim 11 where the metal is sodium, calcium or magnesium.

13. The composition of claim 11 wherein the overbased carboxylate is treated with a borating agent.

14. The composition of claim 1 wherein the metal overbased composition is a metal overbased phenate derived from the reaction of an alkylated phenol wherein the alkyl group has at least 6 aliphatic carbon atoms with formaldehyde.

15. The composition of claim 14 wherein the metal is sodium, calcium or magnesium.

16. The composition of claim 14 wherein the phenate is derived from the reaction of an alkylated phenol wherein the alkyl group has at least 6 aliphatic carbon atoms with a sulfurization agent.

17. The composition of claim 16 wherein the metal is sodium, calcium or magnesium.

18. The composition of claim 14 wherein the overbased phenate is treated with a borating agent.

19. The composition of claim 14 wherein the phenate is derived from the reaction of an alkylated phenol having at least 6 aliphatic carbon atoms with a sulfurization agent and formaldehyde.

20. The composition of claim 19 wherein the metal is sodium, calcium or magnesium.

21. The composition of claim 1 wherein the carboxylic dispersant composition comprises the reaction of a hydrocarbon substituted succinic acid-producing compound with at least about one-half equivalent, per equivalent of acid producing compound, of an organic hydroxy compound or an amine containing at least one hydrogen attached to a nitrogen atom, or a mixture of said hydroxy compound and amine.

22. The composition of claim 21 wherein the succinic acid-producing compound contains an average of at least about 50 aliphatic carbon atoms in the substituent.

23. The composition of claim 21 wherein the succinic acid producing compound is selected from the group consisting of succinic acids, anhydrides, esters and halides.

24. The composition of claim 21 wherein the hydrocarbon substituent of the succinic acid producing compound is derived from a polyolefin having an Mn value within the range of from about 700 to about 10,000.

25. The composition of claim 21 wherein the amine reacted with the succinic acid producing compound is characterized by the formula $$R^7R^8NH$$

wherein $R^7$ and $R^8$ are each independently hydrogen, or hydrocarbon, amino-substituted hydrocarbon, hydroxy-substituted hydrocarbon, alkoxy-substituted hydrocarbon, amino, carbamyl, thiocarbamyl, guanyl, and acylimidoyl groups provided that only one of $R^7$ and $R^8$ may be hydrogen.

26. The composition of claim 21 wherein the amine reacted with the succinic acid producing compound is a polyamine.

27. The composition of claim 1 wherein the diaryl amine is

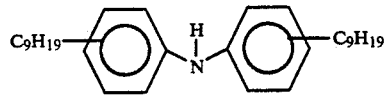

28. The composition of claim 1 wherein the sulfurized composition is a sulfurized olefin prepared by reacting an olefin/sulfur halide complex by contacting the complex with a protic solvent in the presence of metal ions at a temperature in the range of 40° C. to 120° C. and thereby removing halogens from the sulfurized complex and providing a dehalogenated sulfurized olefin; and isolating the sulfurized olefin.

29. The composition of claim 28 wherein the olefin is an alkylene compound containing one double bond and 2 to 50 carbon atoms, and the sulfur halide is a sulfur chloride.

30. The composition of claim 28 wherein the olefin is a mixture of olefins containing isobutene and the sulfur halide is selected from the group consisting of sulfur monochloride, sulfur dichloride and mixtures thereof; the protic solvent is selected from the group consisting of water, alcohols, carboxylic acids and combination thereof; and the metal ions are sodium sulfide/sodium hydrosulfide mixture derived from hydrocarbon purification process streams and sodium hydroxide.

31. The composition of claim 28 wherein the sodium sulfide/sodium hydrosulfide mixture is derived from hydrocarbon purification process streams.

32. The composition of claim 28 wherein the olefin contains one double bond and 2 to 50 carbon atoms and the sulfur halide is a sulfur chloride.

33. The composition of claim 32 wherein the olefin is isobutene, the sulfur halide is sulfur monochloride, and the protic solvent is a water-isopropyl alcohol mixture.

34. The composition of claim 1 wherein the sulfurized composition comprises the reaction product of sulfur and a Diels-Alder adduct in a molar ratio of sulfur to adduct of from about 1:2 to about 4:1 wherein the adduct comprises at least one dienophile selected from the group consisting of alpha, beta ethylenically unsaturated aliphatic carboxylic acid esters, alpha, beta ethylenically unsaturated aliphatic carboxylic acid amides, and alpha, beta ethylenically unsaturated aliphatic halides with at least one aliphatic conjugated diene corresponding to the formula

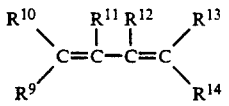

where $R^9$ through $R^{14}$ are each independently selected from the group consisting of hydrogen, alkyl, halo, alkoxy, alkenyl alkenyloxy, carboxy, cyano, amino, alkylamino, dialkylamino, phenyl, and phenyl substituted with one to three substituents corresponding to $R^9$ through $R^{14}$.

35. The composition of claim 34 wherein the molar ratio of sulfur to adduct is from about 2:1 to about 4:1.

36. The composition of claim 35 wherein the diene is further characterized in that $R^{11}$ and $R^{12}$ are hydrogen and $R^9$, $R^{10}$, $R^{13}$, and $R^{14}$ are each independently hydrogen, chloro, or lower alkyl.

37. The composition of claim 36 wherein the dienophile is further characterized in that it contains at least one but not more than two $$-C(O)OR^0$$

where $R^0$ is the residue of a saturated aliphatic alcohol of up to about 40 carbon atoms.

38. The composition of claim 37 wherein the diene is piperylene, isoprene, methylisoprene, chloroprene, or 1,3-butadiene.

39. The composition of claim 38 wherein the dienophile is an ester of acrylic acid or methacrylic acid.

40. The composition of claim 38 wherein the dieneophile is an alkyl ester of acrylic acid or methacrylic acid containing at least 4 carbon atoms in the alkyl group.

41. The composition of claim 40 wherein the diene is 1,3-butadiene.

42. The composition of claim 1 wherein the metal passivator comprises tolyltriazole or an oil-soluble derivative of a dimercaptothiadiazole.

43. The composition of claim 1 wherein said nitrogen-containing mixed ester is characterized by low-temperature viscosity modifying properties of a carboxy-containing interpolymer, said interpolymer having a reduced specific viscosity of from about 0.05 to about 2 and being derived from at least two monomers, the one being ethylene, propylene, isobutene or styrene and the other being maleic acid or anhydride, itaconic acid or anhydride or acrylic acid or ester, said nitrogen-containing ester being substantially free of titratable acidity and being characterized by the presence within its polymeric structure of at least one of each of three pendant polar groups which are derived from the carboxy groups of said nitrogen containing ester:

(A) a relatively high molecular weight carboxylic ester group, said carboxylic ester group having at least 8 aliphatic carbon atoms in the ester radical, (B) a relatively low molecular weight carboxylic ester group having no more than 7 aliphatic carbon atoms in the ester radical, (C) a carbonyl-polyamino group derived from a polyamino compound having one primary or secondary amino radical, wherein the molar ratio of (A):(B):(C) is (60–90):(10–30):(2–15).

44. The composition of claim 1 wherein the molar ratio of (A):(B):(C) is (70–80):(50–25):(5).

45. The composition of claim 1 wherein the interpolymer is a styrene-maleic anhydride interpolymer having a reduced specific viscosity of from about 0.3 to about 1.

46. The composition of claim 1 wherein the relatively high molecular weight carboxylic ester group of (A) has from 8 to 24 aliphatic carbon atoms, the relatively low molecular weight carboxylic ester group of (B) has from 3 to 5 carbon atoms and the carbonylpolyamino group of (C) is derived from a primary-aminoalkyl-substituted tertiary amine.

47. The composition of claim 1 wherein the carboxy-containing interpolymer is a terpolymer of one molar proportion of styrene, one molar proportion of maleic anhydride, and less that about 0.3 molar proportion of a vinyl monomer.

48. The composition of claim 1 wherein said low molecular weight aliphatic olefin of said nitrogen-containing ester is selected from the group consisting of ethylene, propylene or isobutene.

49. The composition of claim 1 wherein said reduced specific viscosity of said nitrogen-containing ester is in the range of about 0.3 to about 1.0.

50. The composition of claim 1 wherein said low molecular weight aliphatic olefin of said nitrogen-containing ester is selected from the group consisting of ethylene, propylene or isobutene.

51. The composition of claim 1 wherein said alpha, beta-unsaturated aliphatic acid, anhydride or ester of said nitrogen-containing ester is selected from the group consisting of maleic acid or anhydride, itaconic acid or anhydride, or acrylic acid or ester.

52. The composition of claim 1 wherein each of the ester radicals of (A') of said nitrogen-containing ester have from 8 to 24 carbon atoms and the carbonyl-polyamino group (B') is derived from a primary aminoalkyl-substituted tertiary amine.

53. The composition of claim 1 wherein the molar ratio of carboxy groups of said interpolymer of said nitrogencontaining ester esterified to provide (A') to carboxy groups neutralized to provide (B') is about 95:5.

54. The composition of claim 1 where said interpolymer of said nitrogen-containing ester is a terpolymer of one molar proportion of styrene, one molar proportion of maleic anhydride, and less than about 0.3 molar proportion of a vinyl monomer.

55. The composition of claim 1 where said polyamino compound of said nitrogen-containing ester is aminopropyl morpholine.

56. The composition of claim 1 further comprising, (D) at least one synthetic ester base oil.

57. The composition of claim 56 wherein the synthetic ester base oil comprises the reaction of a monocarboxylic acid of the formula $$R^{16}COOH$$

or a dicarboxylic acid of the formula

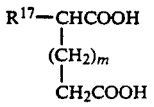

with an alcohol of the formula $$R^{18}(OH)_n$$

wherein $R^{16}$ is a hydrocarbyl group containing from about 5 to about 12 carbon atoms, $R^{17}$ is hydrogen or a hydrocarbyl group containing from about 4 to about 50 carbon atoms, $R^{18}$ is a hydrocarbyl group containing from 1 to about 18 carbon atoms, m is an integer of from 0 to about 6 and n is an integer of from 1 to about 6.

58. The composition of claim 57 wherein $R^{16}$ contains 11 carbon atoms, $R^{18}$ contains 5 carbon atoms as a neo group and n is 2.

59. The composition of claim 57 wherein $R^{17}$ is hydrogen, m is 2, $R^{18}$ contains 4 carbon atoms, and n is 1.

60. A multipurpose power transmission fluid, comprising:

(A) from about 60–90% by weight of a triglyceride comprising rapeseed oil;

(B) from about 1–12% by weight of at least one detergent-inhibitor additive comprising a calcium overbased alkyl sulfonic acid wherein the alkyl group contains at least about 15 carbon atoms, a carboxylic dispersant compound, a sulfurized olefin, tolyltriazole and a derivative of dimercaptothiadiazole; and (C) from about 1–8% by weight of a viscosity modifying additive.

61. A multipurpose power transmission fluid, comprising:

(A) from about 60–90% by weight of a triglyceride comprising rapeseed oil;

(B) from about 1–12% by weight of at least one detergent-inhibitor additive comprising a calcium overbased alkyl sulfonic acid wherein the alkyl group contains at least about 15 carbon atoms, a carboxylic dispersant compound, a sulfurized olefin, tolyltriazole and a derivative of dimercaptothiadiazole;

(C) from about 1–8% by weight of a viscosity modifying additive; and (D) from about 0–25% by weight of a synthetic oil of the formula

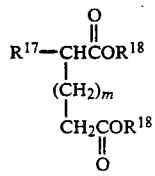

wherein $R^{17}$ is hydrogen, $R^{18}$ contains 9 carbon atoms and m is 2.

* * * * *